US010601182B2

(12) United States Patent
Horino et al.

(10) Patent No.: US 10,601,182 B2
(45) Date of Patent: Mar. 24, 2020

(54) CONNECTOR

(71) Applicant: KYOCERA CORPORATION, Kyoto (JP)

(72) Inventors: Shintaro Horino, Santa Clara, CA (US); Genta Yamazaki, Sagamihara (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/322,084

(22) PCT Filed: Aug. 1, 2017

(86) PCT No.: PCT/JP2017/027932
§ 371 (c)(1),
(2) Date: Jan. 30, 2019

(87) PCT Pub. No.: WO2018/025874
PCT Pub. Date: Feb. 8, 2018

(65) Prior Publication Data

US 2019/0173233 A1 Jun. 6, 2019

(30) Foreign Application Priority Data

Aug. 4, 2016 (JP) ..... 2016-153685

(51) Int. Cl.
*H01R 13/658* (2011.01)
*H01R 13/6582* (2011.01)
(Continued)

(52) U.S. Cl.
CPC ..... *H01R 13/6582* (2013.01); *H01R 12/73* (2013.01); *H01R 13/6583* (2013.01); *H01R 13/6594* (2013.01); *H01R 12/716* (2013.01)

(58) Field of Classification Search
CPC ..... H01R 13/6582; H01R 13/6583
See application file for complete search history.

(56) References Cited

U.S. PATENT DOCUMENTS 7,059,908 B2 6/2006 Yamaguchi
7,147,480 B2 * 12/2006 Ikeda ..... H05K 3/363 439/67
(Continued)

FOREIGN PATENT DOCUMENTS

JP 2006-059589 A 3/2006
JP 2008-146870 A 6/2008
(Continued)

OTHER PUBLICATIONS

International Search Report dated Feb. 1, 2018, in corresponding Japanese Patent Application No. PCT/JP2017/027932.

*Primary Examiner* — James Harvey
(74) *Attorney, Agent, or Firm* — Duane Morris LLP

(57) ABSTRACT

Provided is a connector that has a reduced profile and is capable of bringing shielding structures of two connectors coupled together into contact with each other. A connector (10) according to the present disclosure includes a first connector (20) and a second connector (70). The first connector (20) is equipped with a first insulator (30) that includes a pair of outer peripheral walls (32) opposing each other and a fitting projection (33) formed between the pair of outer peripheral walls (32), and a first shielding member (60) supported by the first insulator (30). The second connector (70) includes a second insulator (80) equipped with a fitting recess (83) fit to the fitting projection (33), and a second shielding member (110) supported by the second insulator (80). When the first connector (20) and the second connector (70) are fitted to each other, the first shielding member (60) and the second shielding member (110) are fitted to each other.

10 Claims, 19 Drawing Sheets

(51) Int. Cl.

| | |
|---|---|
| ***H01R 12/73*** | (2011.01) |
| ***H01R 13/6583*** | (2011.01) |
| ***H01R 13/6594*** | (2011.01) |
| *H01R 12/71* | (2011.01) |

(56) References Cited

U.S. PATENT DOCUMENTS

| | | | | |
|---|---|---|---|---|
| 7,652,890 | B2 * | 1/2010 | Ohsawa | G11B 5/486 174/254 |
| 2006/0040557 | A1 * | 2/2006 | Yamaguchi | H01R 13/6583 439/607.17 |
| 2008/0139057 | A1 | 6/2008 | Fukuchi | |
| 2015/0207248 | A1 * | 7/2015 | Takenaga | H01R 12/716 439/74 |
| 2017/0033479 | A1 * | 2/2017 | Ozeki | H01R 13/6581 |
| 2019/0190209 | A1 * | 6/2019 | Horino | H01R 12/71 |
| 2019/0214772 | A1 * | 7/2019 | Kodama | H01R 12/716 |

FOREIGN PATENT DOCUMENTS

| | | | |
|---|---|---|---|
| JP | 2016-058270 | A | 4/2016 |
| JP | 2016-129148 | A | 7/2016 |

* cited by examiner

CONNECTOR

CROSS REFERENCE TO RELATED APPLICATION

This application claims priority to and the benefit of Japanese Patent Application No. 2016-153685 filed on Aug. 4, 2016, the entire contents of which are incorporated herein by reference.

TECHNICAL FIELD

The present disclosure relates to a connector.

BACKGROUND

Recently, due to significant increases in the information volume and communication speeds of electronic devices, noise suppression for devices is becoming important issue. On the other hand, the progressive miniaturization of recent electronic devices also demands miniaturization of connectors mounted in the electronic devices. As such, a connector with a reduced profile needs to demonstrate a satisfactory noise-shielding effect by reliably bring shielding structures of two connectors coupled together into contact with each other.

According to the circuit board electrical connector of PTL 1, two shielding members cover substantially the entire area of the outer peripheral surface of the housing in order to demonstrate a noise-shielding effect.

CITATION LIST

Patent Literature

PTL 1: JP-A-2018-146870

SUMMARY

Technical Problem

However, according to the circuit board electrical connector described in PTL 1, in a state with reduced profile, there is no consideration in relation to bringing the shielding structures of the two connectors coupled together into contact with each other.

In light of such a problem, the present disclosure aims to provide a connector having a reduced profile that is capable of bringing the shielding structures of the two connectors coupled together into contact with each other.

Solution to Problem

In order to solve the above problem, a connector according to a first aspect includes:

a first connector equipped with a first insulator that includes a pair of outer peripheral walls opposing each other, and a fitting projection formed between the pair of outer peripheral walls, and a first shielding member supported by the first insulator; and a second connector equipped with a second insulator having a fitting recess fit to the fitting projection, and a second shielding member supported by the second insulator, wherein, when the first connector and the second connector are fitted to each other, the first shielding member and the second shielding member are fitted to each other.

In the connector according to a second aspect, the second shielding member includes a bend curved in an approximate U-shape, and the first shielding member includes an elastic deformation portion that accommodates the bend when the first shielding member is fitted to the second shielding member.

In the connector according to a third aspect, the first shielding member includes a first outer peripheral shielding portion constituted by an outer surface, the second shielding member includes a second outer peripheral shielding portion constituted by an outer surface, and when the first connector and the second connector are fitted to each other, a space is formed between the first outer peripheral shielding portion and the second outer peripheral shielding portion.

In the connector according to a fourth aspect, the first shielding member includes a first latch at an internal end portion, the second shielding member includes a second latch at a position corresponding to the internal end portion, and the first latch and the second latch engage each other when the first connector and the second connector are fitted to each other.

In the connector according to a fifth aspect, the first shielding member includes a guiding portion that protrudes from a top end of the elastic deformation portion in an inclined manner toward the inside of the first insulator.

In the connector according to a sixth aspect, the first shielding member includes a plurality of through holes that are formed throughout the elastic deformation portion and spaced apart from one another at predetermined intervals.

In the connector according to a seventh aspect, the first shielding member includes a plurality of first mounting portions formed at an end portion of the first outer peripheral shielding portion and spaced apart from one another at predetermined intervals.

In the connector according to an eighth aspect, the first mounting portion extends inward in an approximate L-shape from the end portion of the first outer peripheral shielding portion.

In the connector according to a ninth aspect, the second shielding member includes a plurality of second mounting portions formed at an end portion of the second outer peripheral shielding portion and spaced apart from one another at predetermined intervals.

In the connector according to a tenth aspect, the second mounting portion linearly extends in a fitting direction from the end portion of the second outer peripheral shielding portion.

Advantageous Effect

The connector according to the embodiment of the present disclosure has a reduced profile and is capable of bringing shielding structures of two connectors coupled together into contact with each other.

DETAILED DESCRIPTION

Hereinafter, an embodiment will be described with reference to the accompanying drawings. Terms such as front-rear direction, left-right direction, and up-down direction used herein correspond to directions indicated by arrows in the figures. In the following description, a first connector is referred to as a receptacle connector 20, and a second connector is referred to as a plug connector 70. However, this is not restrictive. The first connector may function as a plug and the second connector may function as a receptacle.

In the following description, the receptacle connector 20 and the plug connector 70 are fitted to circuit boards CB1 and CB2, respectively, in a direction perpendicular thereto. That is, the receptacle connector 20 and the plug connector 70 are fitted along the up-down direction. However, this is not restrictive and the receptacle connector 20 and the plug connector 70 may be fitted to the circuit boards CB1 and CB2, respectively, in a direction parallel therewith. Alternatively, one of the receptacle connector 20 and the plug connector 70 may be fitted to the corresponding circuit board CB1 or CB2 in a direction perpendicular thereto, while the other is fitted to the corresponding circuit board CB1 or CB2 in a direction parallel therewith. The receptacle connector 20 or the plug connector 70 may be coupled to a circuit board other than a rigid board, e.g., a flexible printed circuit board (FPC).

Figure 1:
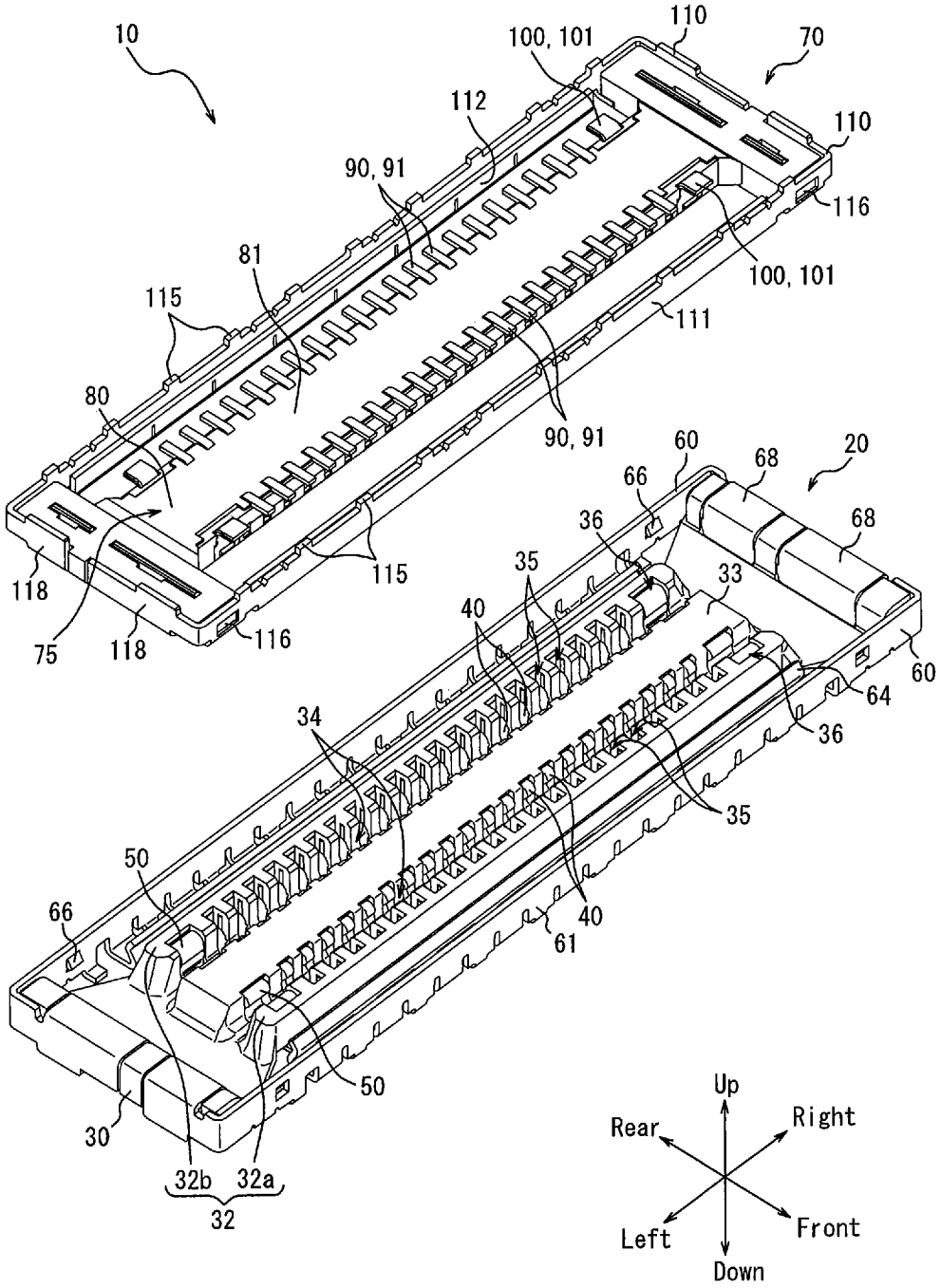
FIG. 1 is a top perspective view illustrating a state in which, in a connector according to an embodiment, a receptacle connector and a plug connector are separated from each other.

FIG. 1 is a top perspective view of the connector 10 according to the present embodiment in a state in which the receptacle connector 20 and the plug connector are separated from each other.

The connector 10 according to the present embodiment includes, as primary components, the receptacle connector 20 (a first connector) and the plug connector 70 (a second connector).

Figure 2:
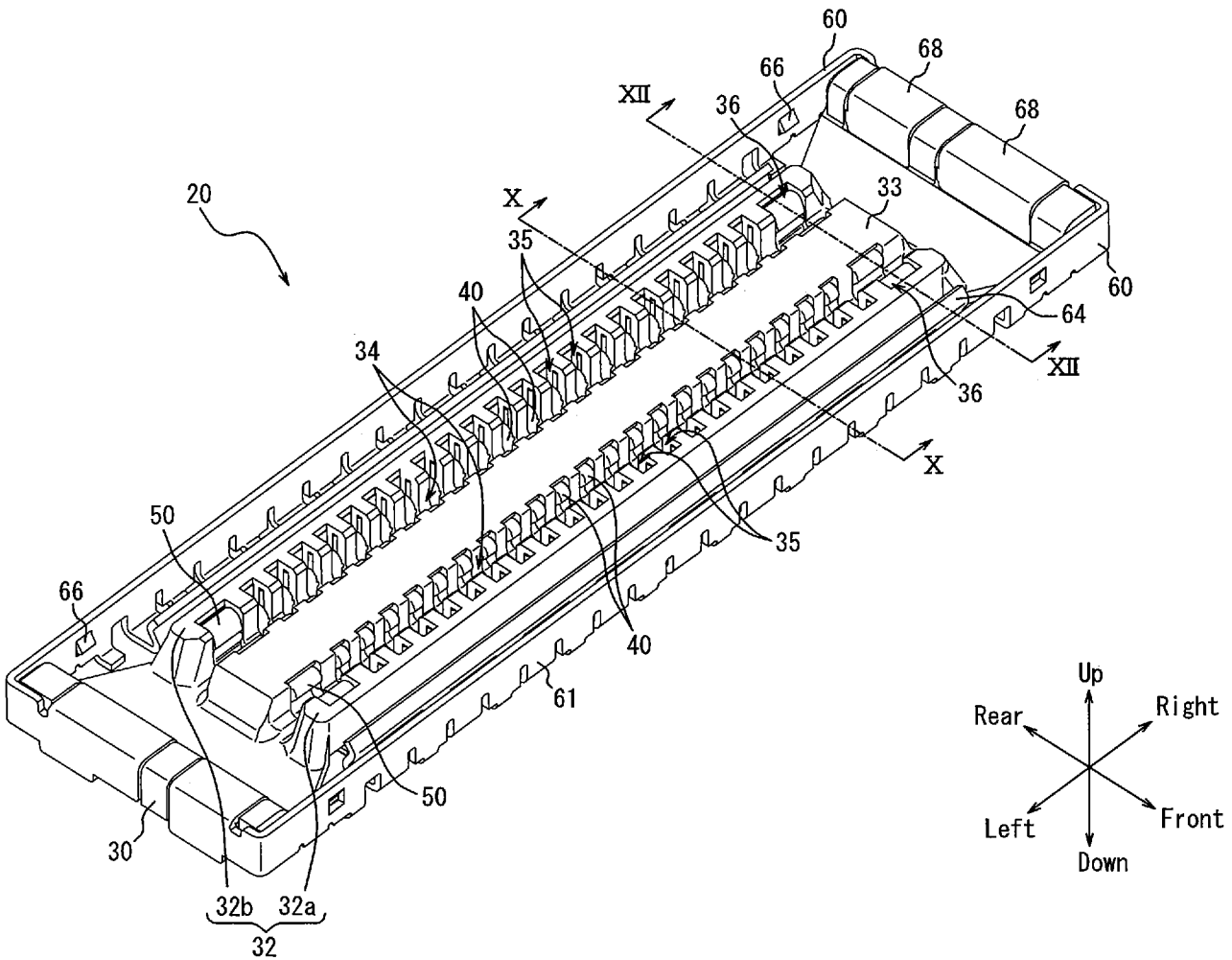
FIG. 2 is a top perspective view of the receptacle connector.
Figure 3:
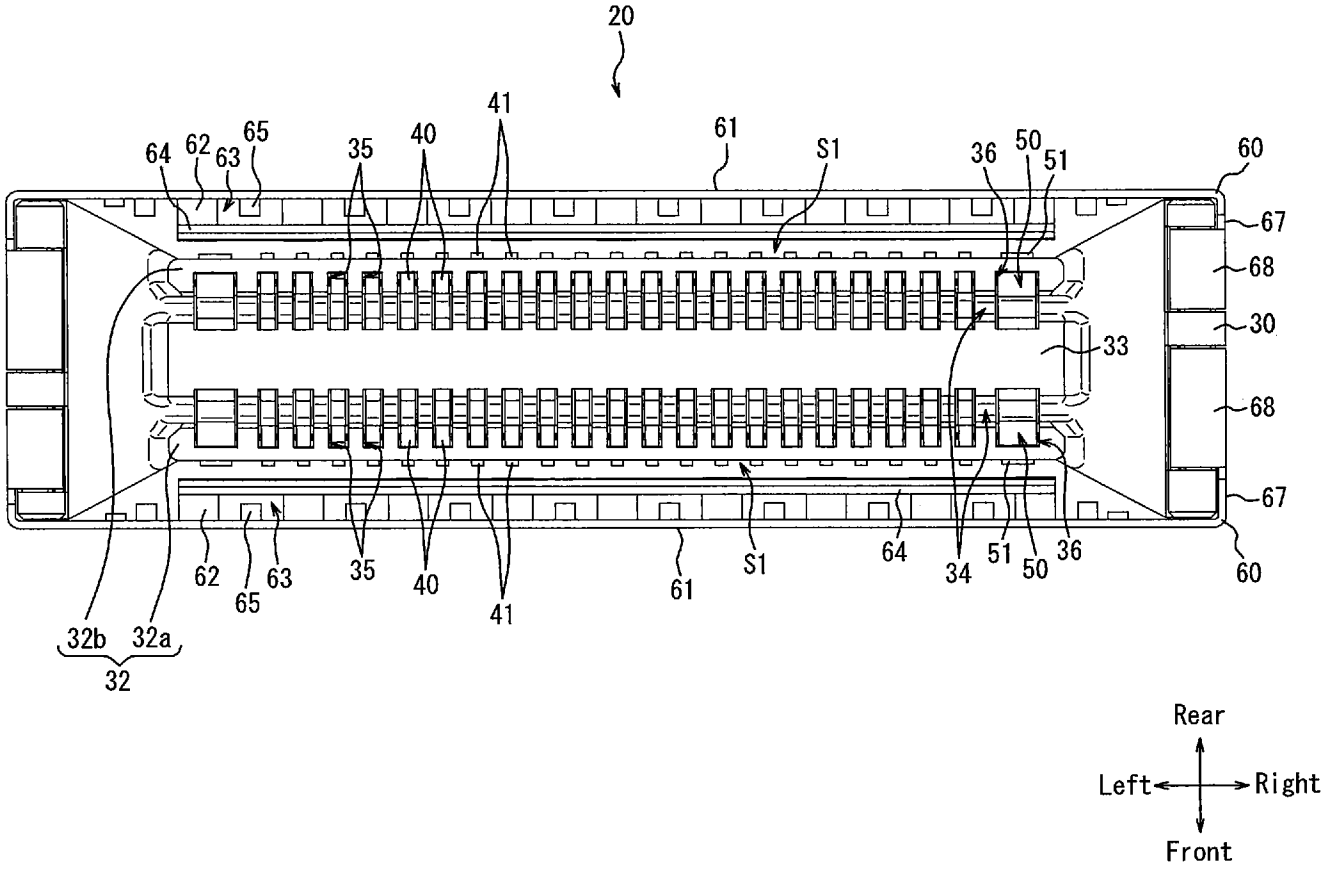
FIG. 3 is a top view of the receptacle connector.
Figure 4:
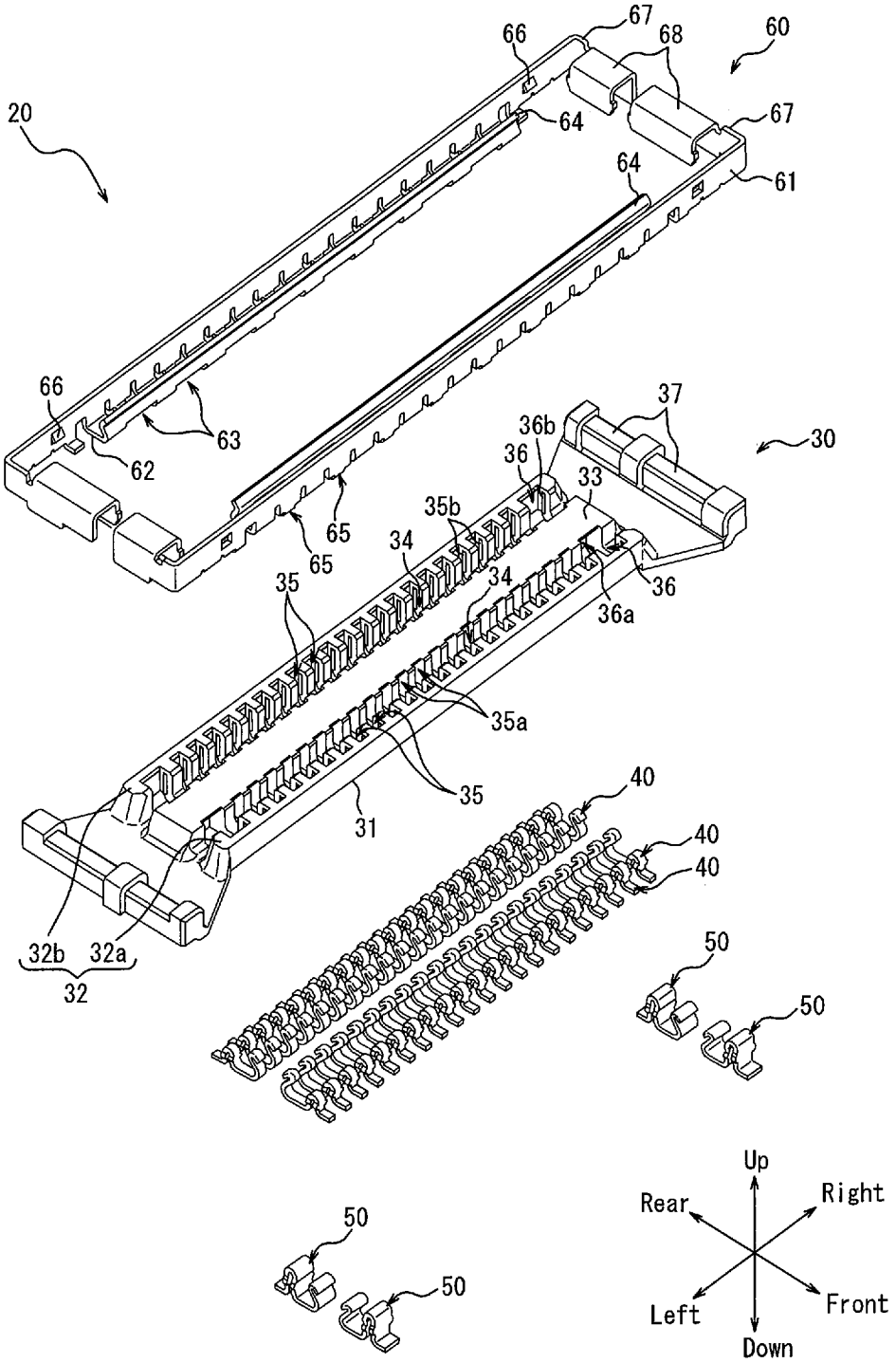
FIG. 4 is an exploded top perspective view of the receptacle connector.
Figure 5:
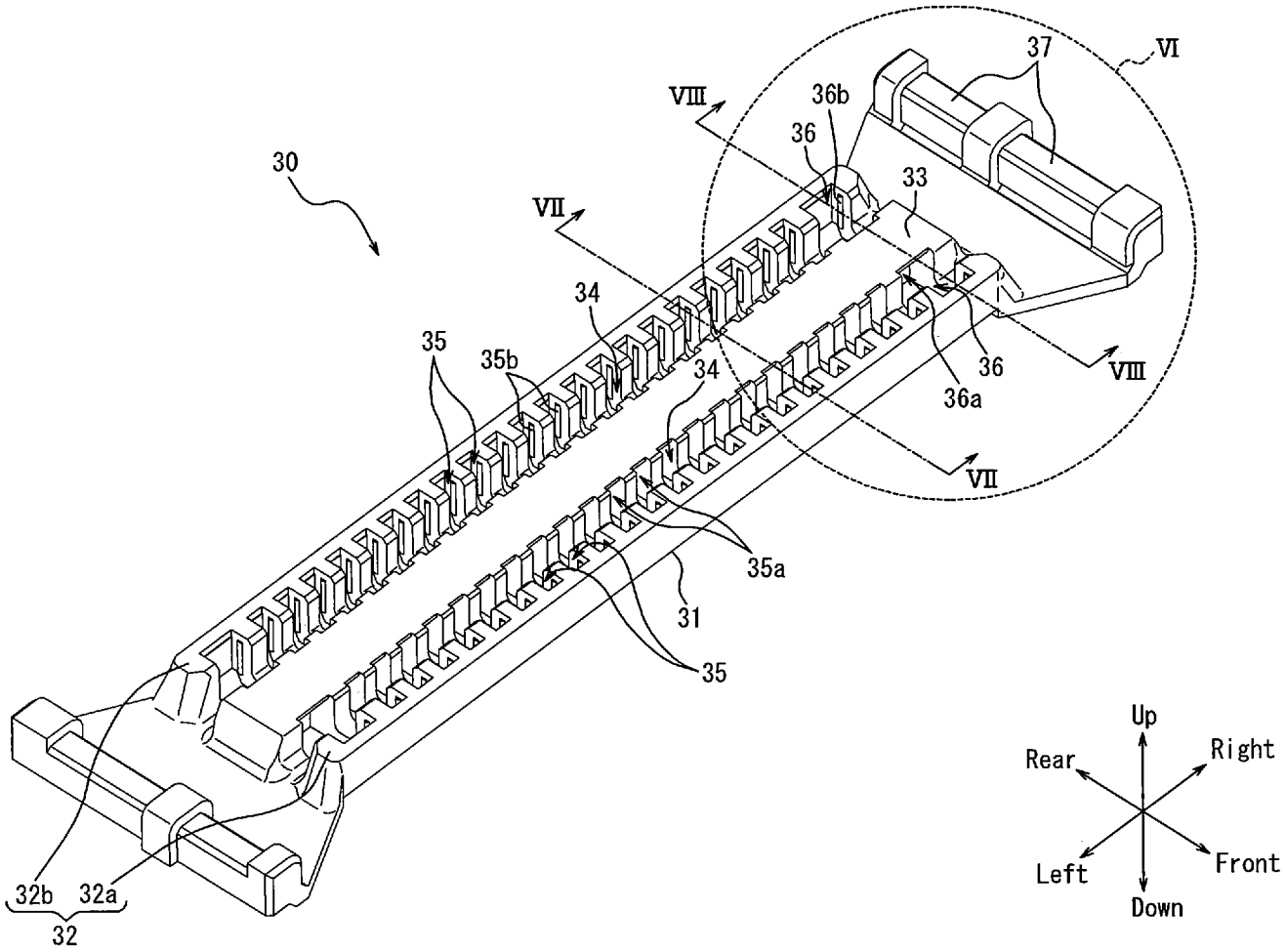
FIG. 5 is a top perspective view of a receptacle insulator.
Figure 6:
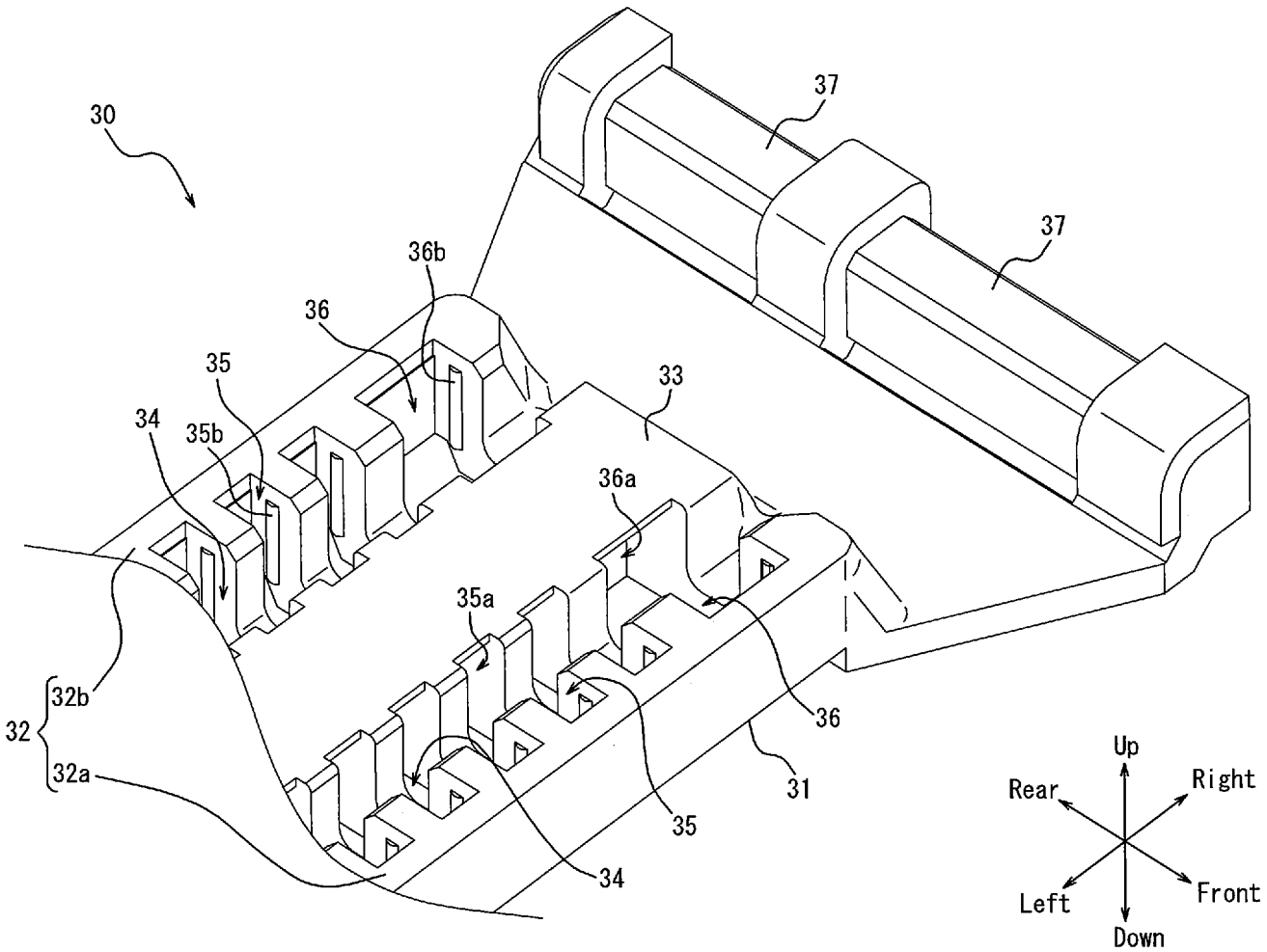
FIG. 6 is an enlarged view of a VI-portion of FIG. 5.
Figure 7:
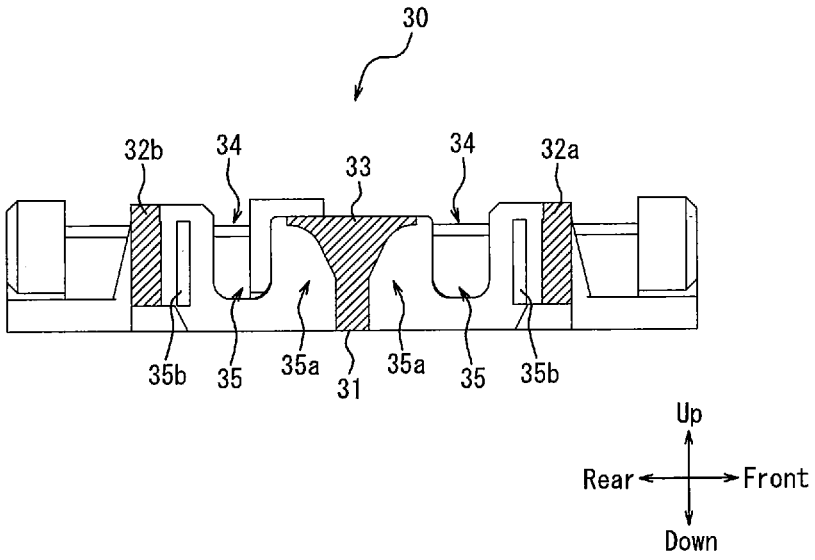
FIG. 7 is a cross-sectional view taken from arrow VII-VII of FIG. 5.
Figure 8:
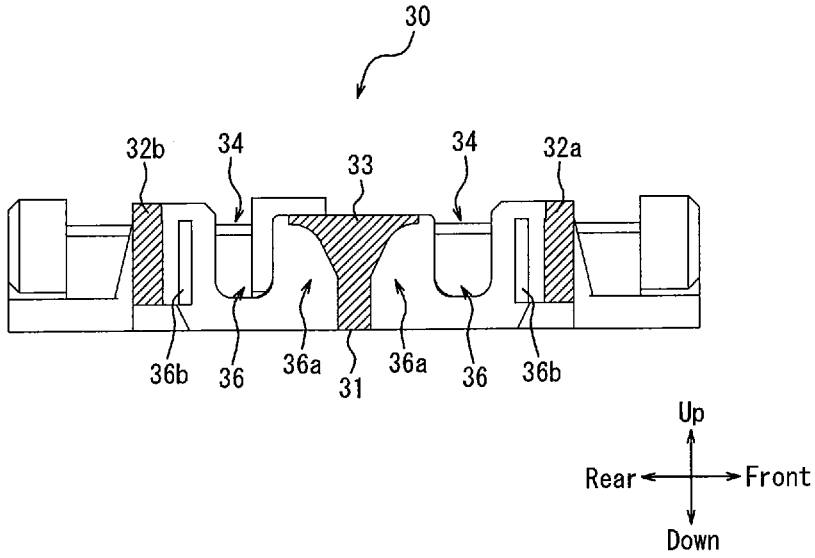
FIG. 8 is a cross-sectional view taken from arrow VIII-VIII of FIG. 5.
Figure 9:
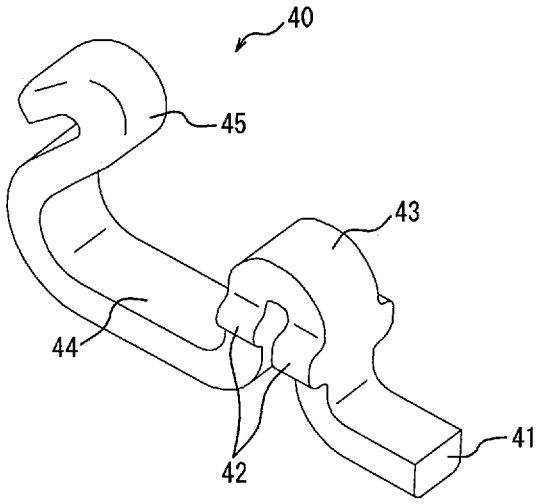
FIG. 9 is a top perspective view of a receptacle contact.
Figure 10:
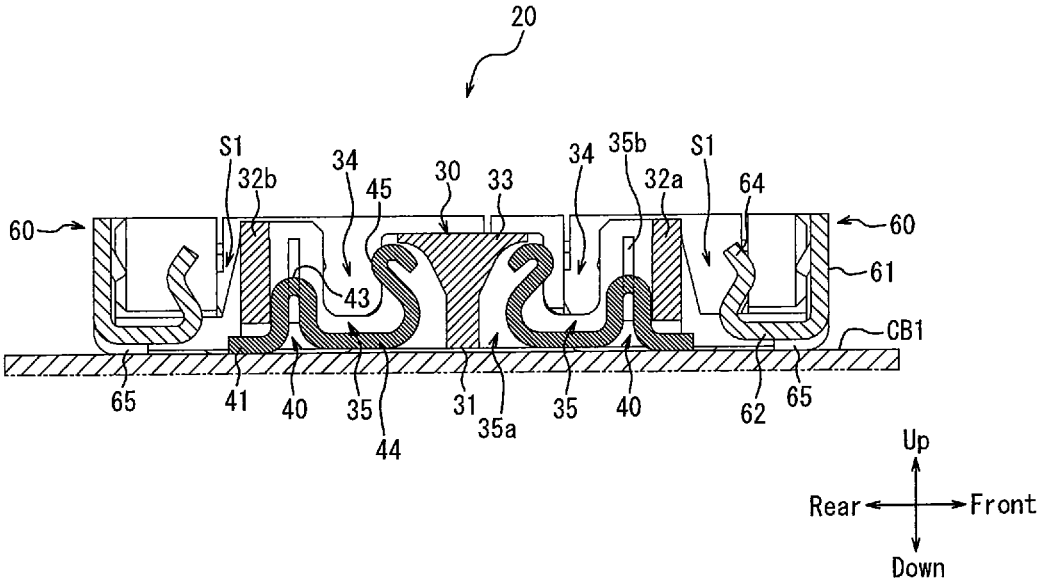
FIG. 10 is a cross-sectional view taken from arrow X-X of FIG. 2.
Figure 11:
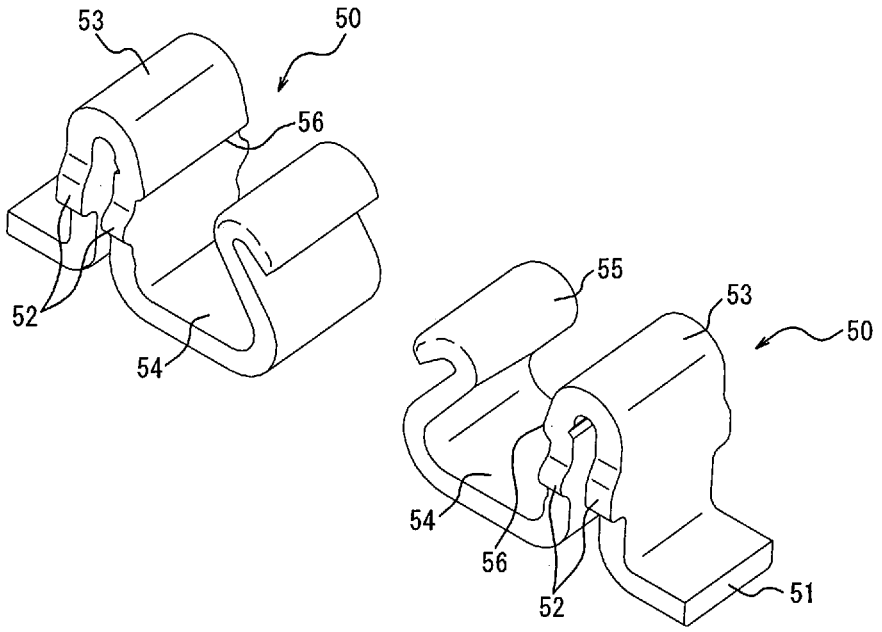
FIG. 11 is a top perspective view of a receptacle power-source contact.
Figure 12:
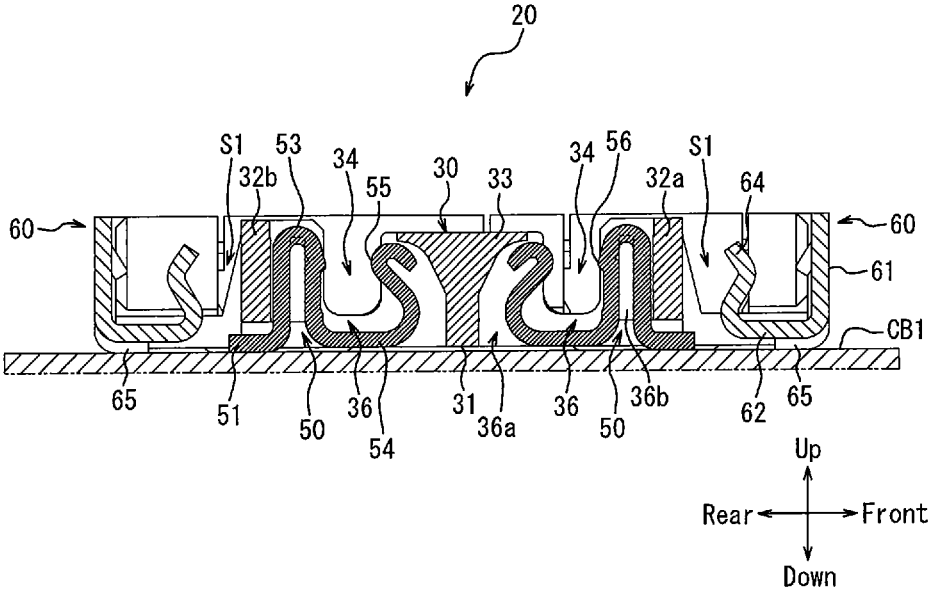
FIG. 12 is a cross-sectional view taken from arrow XII-XII of FIG. 2.
Figure 13:
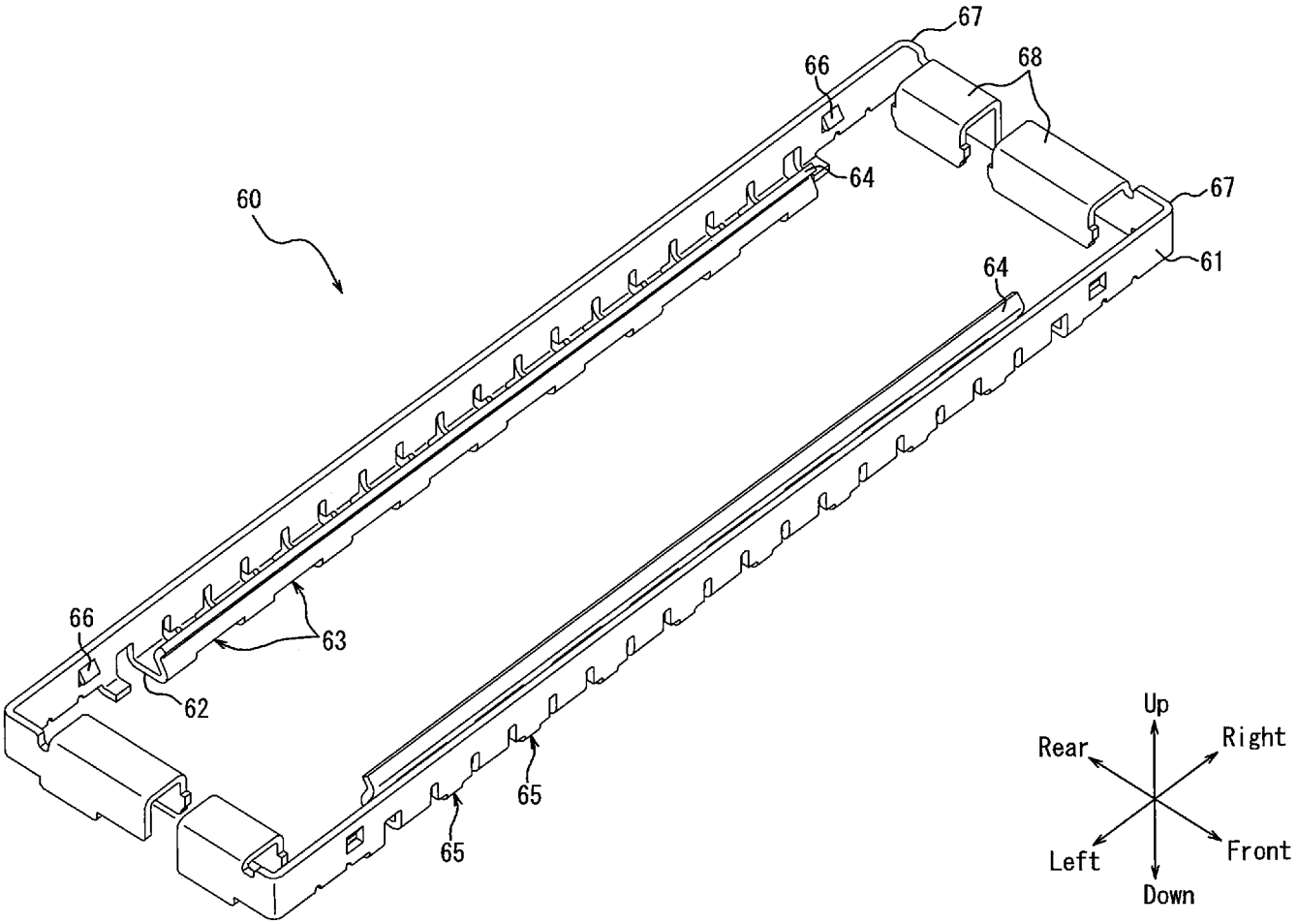
FIG. 13 is a top perspective view of a pair of receptacle shielding members.

FIG. 2 is a top perspective view of the receptacle connector 20. FIG. 3 is a top view of the receptacle connector 20. FIG. 4 is an exploded top perspective view of the receptacle connector 20. FIG. 5 is a top perspective view of a receptacle insulator 30. FIG. 6 is an enlarged view of a VI-portion of FIG. 5. FIG. 7 is a cross-sectional view taken from arrow VII-VII of FIG. 5. FIG. 8 is a cross-sectional view taken from arrow VIII-VIII of FIG. 5. FIG. 9 is a top perspective view of a receptacle contact 40. FIG. 10 is a cross-sectional view taken from arrow X-X of FIG. 2. FIG. 11 is a top perspective view of a receptacle power-source contact 50. FIG. 12 is a cross-sectional view taken from arrow XII-XII of FIG. 2. FIG. 13 is a top perspective view of a pair of receptacle shielding members 60.

A configuration of the receptacle connector 20 will be described in detail with reference mainly to FIG. 2 to FIG. 13.

As illustrated in FIG. 4, the receptacle connector 20 primarily includes the receptacle insulator 30 (a first insulator), a plurality of receptacle contacts 40 (contacts), four receptacle power-source contacts 50, and a pair of receptacle shielding members 60 (first shielding members).

The receptacle insulator 30 is formed by injection molding of a synthetic resin having insulating and heat resistant properties. The receptacle insulator 30 extends in the left-right direction (see FIG. 5). The receptacle insulator 30 includes a bottom plate 31 constituting the bottom, a pair of outer peripheral walls 32 that protrude upward from front and rear end portions on the top surface of the bottom plate 31 and face each other, and a fitting projection 33 that protrudes upward from the top surface of the bottom plate 31 and is formed between the pair of outer peripheral walls 32. The fitting projection 33 is positioned inside the outer peripheral walls 32 with a space therefrom and linearly extends in the left-right direction. The spaces formed between the outer peripheral walls 32 and the fitting projection 33 constitute a pair of fitting recesses 34.

Across the top and rear surfaces of the front wall 32*a* of the outer peripheral wall 32, the top surface of the bottom plate 31, and the front and top surfaces of the fitting projection 33, a plurality of contact fitting grooves 35 for attaching a plurality of receptacle contacts 40 are provided in a line in a recessed manner in the left-right direction. Similarly, across the top and rear surfaces of the rear wall 32*b* of the outer peripheral wall 32, the top surface of the bottom plate 31, and the rear and the top surfaces of the fitting projection 33, a plurality of contact fitting grooves 35 for attaching a plurality of receptacle contacts 40 are provided in a line in a recessed manner in the left-right direction. Each of the contact fitting grooves 35 is formed throughout the receptacle insulator 30 in the up-down direction. The number of the contact fitting grooves 35 is equal to the number of the receptacle contacts 40. The contact fitting grooves 35 include deformation allowing grooves formed on the front and rear surfaces of the fitting projection 33 in a manner recessed deeper into the fitting projection 33 (see FIG. 7). The contact fitting grooves 35 also include contact engaging projections 35*b* that extend in the up-down direction and project on both left and right side surfaces of the grooves formed on the rear surface of the front wall 32*a* and the front surface of the rear wall 32*b*.

Power-source contact fitting grooves 36 for fitting the receptacle power-source contacts 50 are formed in a recessed manner across the top and rear surfaces in the left and right end portions of the front wall 32*a*, the top surface of the bottom plate 31, and the front and top surfaces in the left and right end portions of the fitting projection 33. Similarly, the power-source contact fitting grooves 36 for fitting the receptacle power-source contacts 50 are formed in a recessed manner across the top and front surfaces in the left and right end portions of the rear wall 32*b*, the bottom portion (the top surface) of the bottom plate 31, and the rear and the top surfaces in the left and right end portions of the fitting projection 33. Each of the power-source contact fitting grooves 36 is formed throughout the receptacle insulator 30 in the up-down direction. The number of the power-source contact fitting grooves 36 is equal to the number of the receptacle power-source contacts 50. The power-source contact fitting grooves 36 include a deformation allowing groove 36*a* that is formed on each of the front and rear surfaces of the fitting projection 33 in a manner further recessed on the fitting projection 33 (see FIG. 8). The power-source contact fitting grooves 36 also include power-source contact engaging projections 36*b* that extend in the up-down direction and project from both left and right side surfaces of the grooves formed on the rear surface of the front wall 32*a* and the front surface of the rear wall 32*b*.

The right and left end portions of the receptacle insulator 30 include a pair of supports 37 for supporting a pair of receptacle shielding members 60 (see FIG. 5). The pair of supports 37 is provided in point-symmetrical arrangement with respect to left and right end portions of the receptacle insulator 30. In each of the right and left end portions, the pair of supports 37 is formed such that one of the lengths in the front-rear direction is shorter than the other. A front-rear width of the pair of supports 37 in its entirety, in each of the right and left end portions, is wider than the front-rear width between the outer surface of the front wall 32*a* and the outer surface of the rear wall 32*b*.

Each of the receptacle contacts 40 is formed by processing a thin plate made of a copper alloy having a spring-like elasticity (e.g., phosphor bronze, beryllium copper, or titanium copper) or Corson copper alloy into a shape as illustrated in the figure (see FIG. 9) by using a progressive die (stamping). Each of the receptacle contacts 40 is plated with gold or tin after nickel plate undercoating.

The receptacle contact 40 includes a mounting portion 41 that extends outward in an approximate L shape. The receptacle contact 40 also includes a pair of latches 42 constituted by a portion continuous with the upper inner edge portion of the mounting portion 41 and another portion that is spaced apart from, and opposite to, the above portion. The receptacle contact 40 further includes a bend 43 that couples the pair of latches 42 together, an elastic contact piece 44 having an approximate S-shape that is continuous with the latch 42 formed on the inner side, and a contact portion 45 (a first contact) formed to face outward on a distal portion of the elastic contact piece 44.

The bend 43 is formed at a position lower than a portion of the contact portion 45 that is most protruding toward the bend 43. The elastic contact piece 44 is wider than the bend 43. The distal end of the elastic contact piece 44 is formed at a height similar to the portion of the contact portion 45 that is most protruding toward the bend 43.

Each of the receptacle contacts 40 is press-fit to the receptacle insulator 30 from below and, when the pair of latches 42 engages with the contact engaging projection 35*b*, latches onto the right and left inner wall surfaces of the contact fitting grooves 35. Thus, each of the receptacle contacts 40 is retained within the corresponding contact fitting groove 35 (see FIGS. 4 and 10). When the receptacle contact 40 is retained by the receptacle insulator 30 (within the contact fitting grooves 35), the elastic contact piece 44 is spaced apart from the inner surface of the deformation allowing groove 35*a*. Thus, the elastic contact piece 44 may be elastically deformed in the front-rear direction within the deformation allowing groove 35*a* (see FIG. 10). The mounting portion 41 of each of the receptacle contacts 40 is positioned on the outer peripheral side of the outer peripheral wall 32. That is, the distal end of the mounting portion 41 of each of the receptacle contacts 40 is located outside the outer peripheral wall 32.

The receptacle power-source contact 50 includes a mounting portion 51 extending outward in an approximate L-shape (see FIG. 11). The receptacle power-source contact 50 also includes a pair of latches 52 that include a portion continuous with the upper inner edge portion of the mounting portion 51 and another portion that is opposite to, and spaced apart in the front-rear direction from, the above portion. The receptacle power-source contact 50 includes a curve 53 that couples the pair of latches 52 together, and an elastic contact piece 54 in an approximate S-shape that is continuous with the latch 52 formed on the inner side. The receptacle power-source contact 50 further includes a contact portion 55 that faces outward to a distal end of the elastic contact piece 54, and the projection 56 located on top of the latch 52 formed on the inner side.

Each of the receptacle power-source contacts 50 is press-fit to the receptacle insulator 30 from therebelow and, when the pair of latches 52 and the power-source contact engaging projections 36*b* are engaged together, latches onto the right and left inner wall surfaces of the power-source contact fitting groove 36. Thus, each of the receptacle power-source contacts 50 is retained within the power-source contact fitting groove 36 (see FIGS. 4 and 12). When the receptacle power-source contacts 50 are retained within the receptacle insulator 30 (the power-source contact fitting grooves 36), the elastic contact piece 54 is spaced apart from the inner surface of the deformation allowing groove 36*a*. Thus, the elastic contact piece 54 may be elastically deformed in the front-rear direction within the deformation allowing groove 36*a* (see FIG. 12). The mounting portion 51 of each of the receptacle power-source contacts 50 is positioned on the outer peripheral side of the outer peripheral wall 32. That is, the distal end of the mounting portion 51 of each of the receptacle power-source contacts 50 is located outside the outer peripheral wall 32.

Each of the pair of receptacle shielding members 60 is configured as the same component with the same shape (see FIGS. 3 and 13). Each of the receptacle shielding members 60 is formed by press-forming a metal plate (a conductive material). Each of the receptacle shielding members 60 includes an outer peripheral shielding portion 61 (a first outer peripheral shielding portion) having a plate-like shape that constitutes an outer surface of the receptacle shielding member 60 and extends in the left-right direction. The receptacle shielding member 60 also includes an elastic deformation portion 62 that is formed from the bottom edge of the outer peripheral shielding portion 61 toward the receptacle insulator 30 (inside). The elastic deformation portion 62 horizontally extends with a predetermined width toward the inner side from the bottom edge of the outer peripheral side shielding portion 61 and bends upward and outward at the edge of the portion extending horizontally (see FIG. 12). The space surrounded by the outer peripheral shielding portion 61 and the elastic deformation portion 62 is open at the distal ends thereof. The receptacle shielding member 60 further includes a plurality of through holes 63 formed throughout the elastic deformation portion 62 in the up-down direction and spaced apart from one another at predetermined intervals, and a guide 64 that protrudes inclining toward the inner side of the receptacle insulator 30.

The receptacle shielding member 60 includes a plurality of mounting portions 65 (first mounting portions) that are formed at the bottom of the outer peripheral side shielding portion 61 and spaced apart from one another at predetermined intervals. The mounting portions 65 extend inwardly in an approximate L shape from the bottom portion of the outer peripheral side shielding portion 61. The positions of the mounting portions 65 in the left-right direction coincide with the positions of the corresponding through-holes 63 in the left-right direction. That is, the distal ends of the mounting portions 65 are positioned directly under the through holes 63 (see FIG. 3).

The receptacle shielding member 60 includes latches 66 (first engaging portions) that project from the left and right end portions of the inner side of the receptacle shielding member 60 (see FIG. 13). The latches 66 having a claw shape protrusion, as a pair, at left and right end portions of the inside of the outer peripheral shielding portion 61. The receptacle shielding member 60 includes a pair of transverse portions 67 that extends from the left and right end portions of the outer peripheral shielding portion 61 toward the receptacle insulator 30. The front-rear direction lengths of the transverse portions 67 opposite to each other are asymmetrical. In particular, in the transverse portions 67 opposite to each other, a front-rear direction length of one of the transverse portions 67 is shorter than a front-rear direction length of the other transverse portion 67. In the transverse portions 67 opposite to each other, the front-rear width of the transverse portion 67 having the front-rear direction length longer than the other is wider than half the front-rear direction width of the receptacle connector 20 in its entirety. The pair of transverse portions 67 include respective fitting portions 68. The fitting portions 68 are an approximate U-shape in cross-section. That is, the fitting portions 68 are constituted by three surfaces: a right surface, a left surface, and a top surface. In the pair of mounting portions 68, a front-rear direction length of one of the fitting portions 68 is shorter than a front-rear direction length of the other fitting portion 68. The top end portion of the fitting portion 68 is R-shaped.

Each of the receptacle shielding members 60 is fitted to the receptacle insulator 30 by the engagement between the pair of fitting portions 68 and the support 37 from thereabove (see FIG. 4, FIG. 10, and FIG. 12). When the receptacle shielding member 60 is fitted to the receptacle insulator 30, the receptacle shielding member 60 is partially spaced apart from the receptacle insulator 30. In particular, the outer peripheral wall 32 is spaced apart from the elastic deformation portion 62 and the guide 64 in the front-rear direction. That is, a space S1 is formed across the left-right direction between the outer peripheral wall 32 and the elastic deformation portion 62 and the guide 64. At this point, the distal end of the mounting portion 41 of the receptacle contact 40 and the distal end of the mounting portion 51 of the receptacle power-source contact 50 are visible in the up-down direction (the fitting direction of the first connector and the second connector) in the space S1 (see FIG. 3). The distal end portion of the mounting portion 65 of the receptacle shielding member 60 is visible in the up-down direction in the through-hole 63 (in the fitting direction of the first connector and the second connector).

When the receptacle shielding member 60 is fit to the receptacle insulator 30, the top edge portion of the outer peripheral shielding portion 61 of the receptacle shielding member 60 is positioned slightly above the top surfaces of the outer peripheral wall 32 and the fitting projection 33 of the receptacle insulator 30 (see FIG. 10 and FIG. 12).

The receptacle shielding member 60 has a double-shielding structure along the front-rear direction and the left-right direction. In particular, the shielding structure includes a double structure along the left-right direction with respect to the outer peripheral shielding portion 61 having the flat-plate shape, the elastic deformation portion 62, and the guide 64. Similarly, the shielding structure also includes a double structure along the front-rear direction constituted by the left and right side surfaces of the fitting portion 68.

In the receptacle connector 20 having the configuration as described above, the mounting portion 41 of each of the receptacle contacts 40 is soldered to a circuit pattern formed on the mounting surface of the circuit board CB1 (i.e., a rigid substrate, a first circuit board, see FIG. 10 and FIG. 12). The mounting portion 51 of each of the receptacle power-source contacts 50 is soldered to a power supply pattern formed on the mounting surface. Each of the mounting portions 65 of the receptacle shielding member 60 is soldered to a ground pattern formed on the mounting surface. In this way, the receptacle connector 20 is mounted on the circuit board CB1. The mounting surface of the circuit board CB1 includes electronic components (e.g., a CPU, a controller, a memory, etc.) mounted thereon other than the receptacle connector 20.

A configuration of the plug connector 70 will be described in detail with reference mainly to FIG. 14 to FIG. 21.

Figure 14:
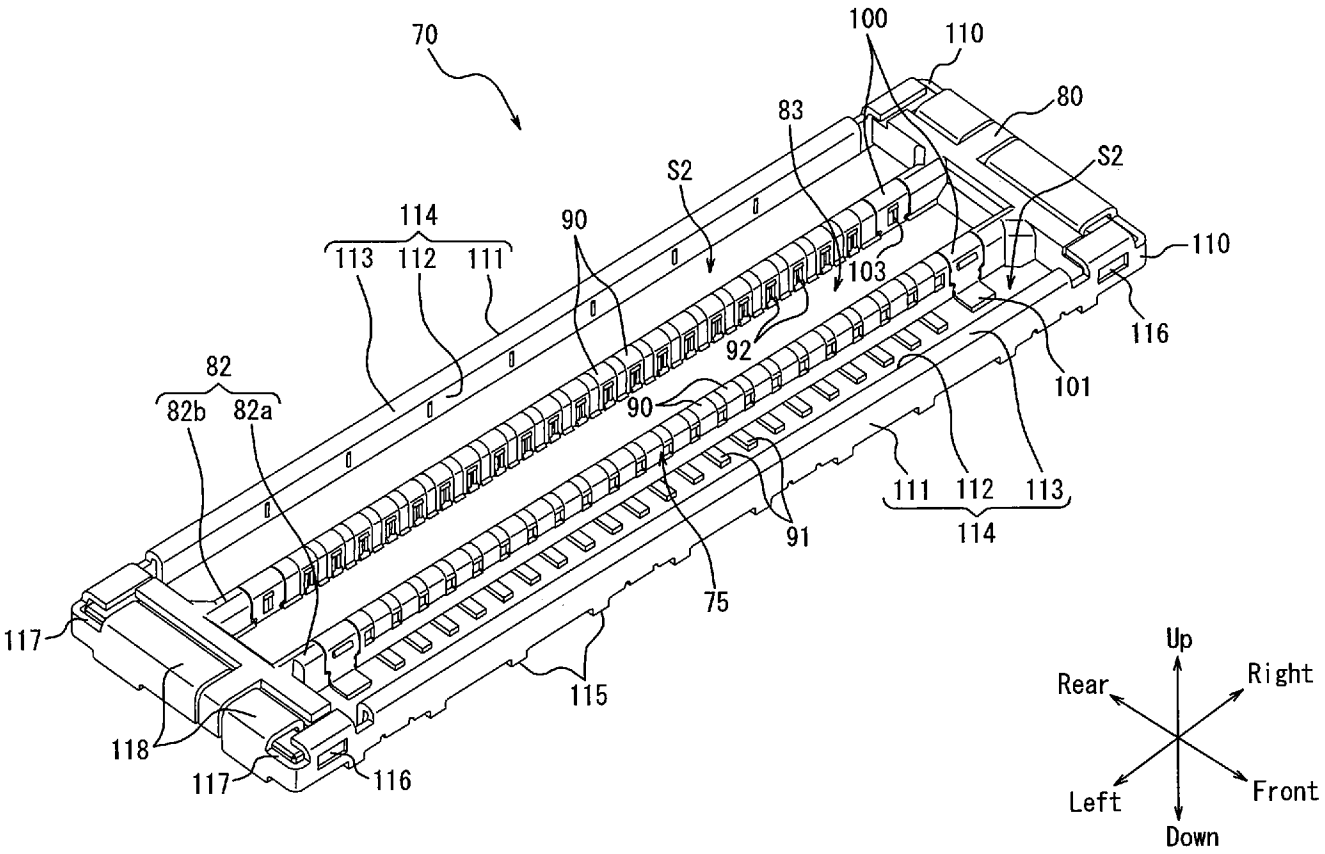
FIG. 14 is a top perspective view of a plug connector.
Figure 15:
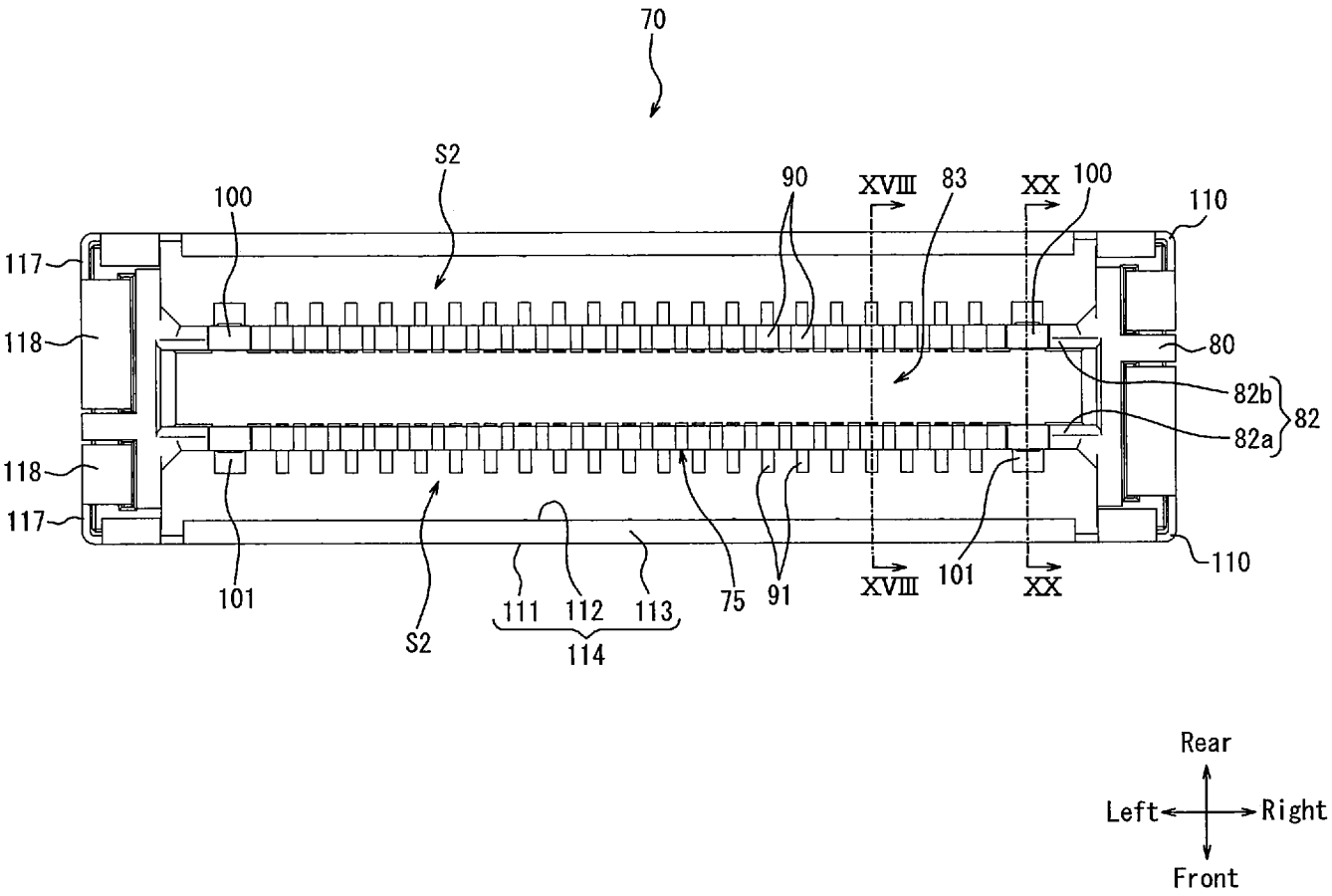
FIG. 15 is a top view of the plug connector.
Figure 16:
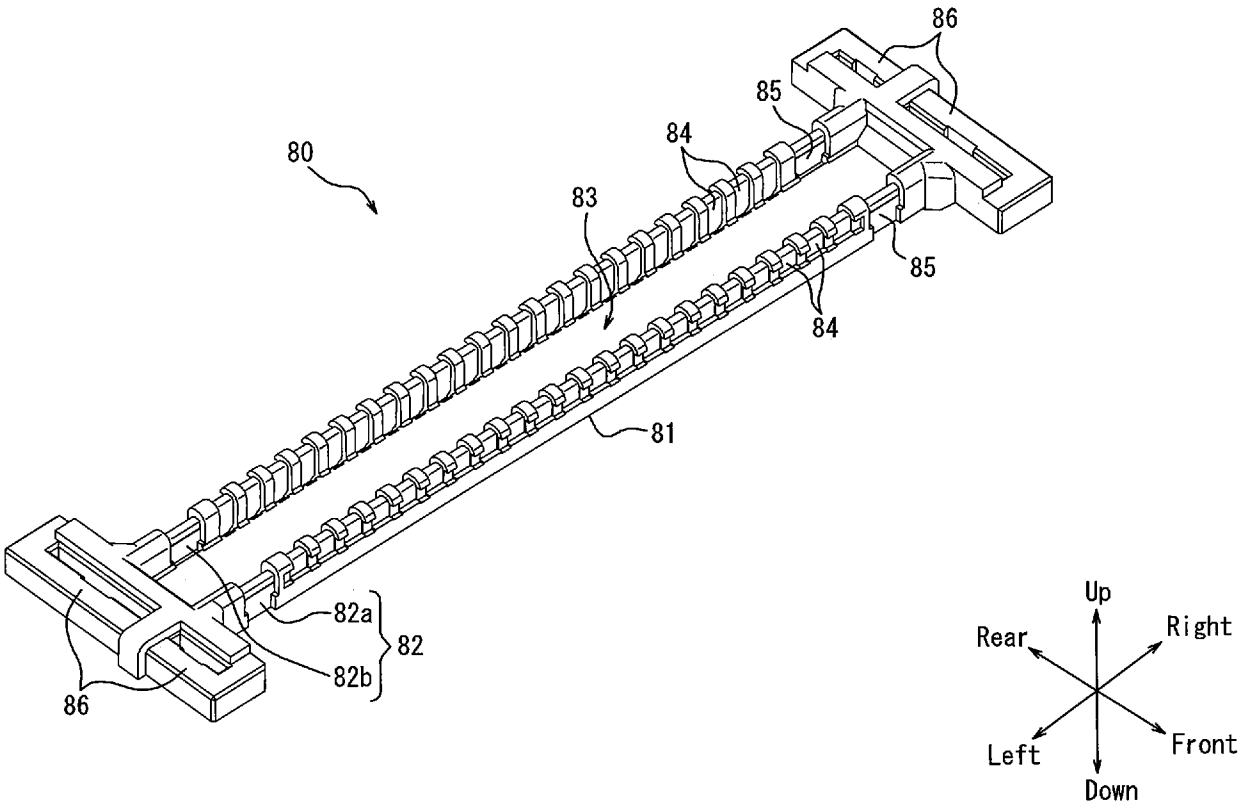
FIG. 16 is a top perspective view of a plug insulator of a molded plug.
Figure 17:
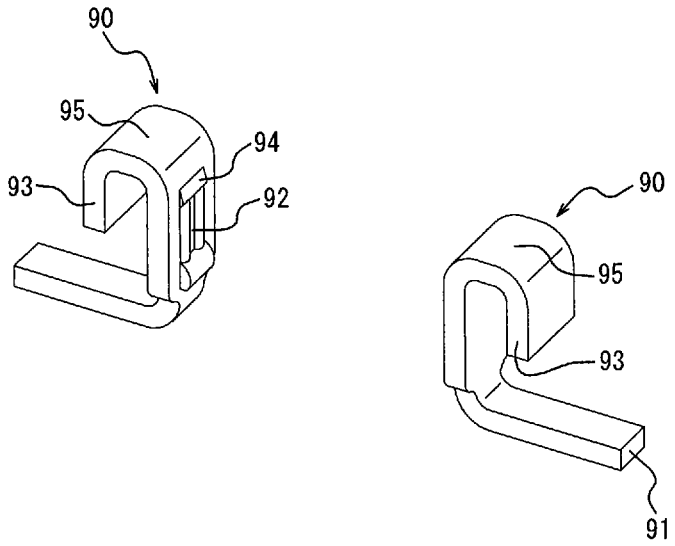
FIG. 17 is a top perspective view of a plug contact.
Figure 18:
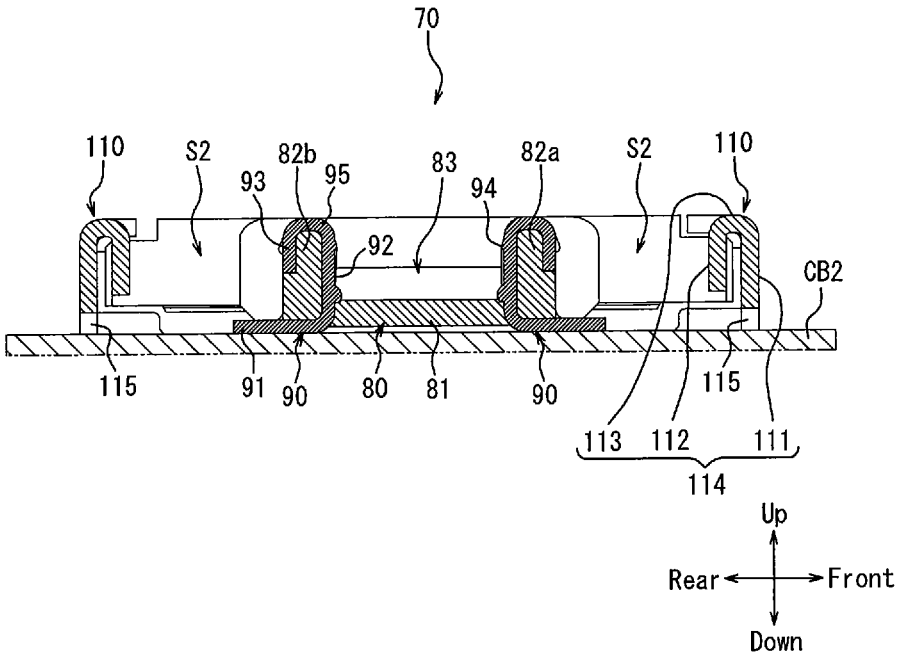
FIG. 18 is a cross-sectional view taken from arrow XVIII-XVIII of FIG. 15.
Figure 19:
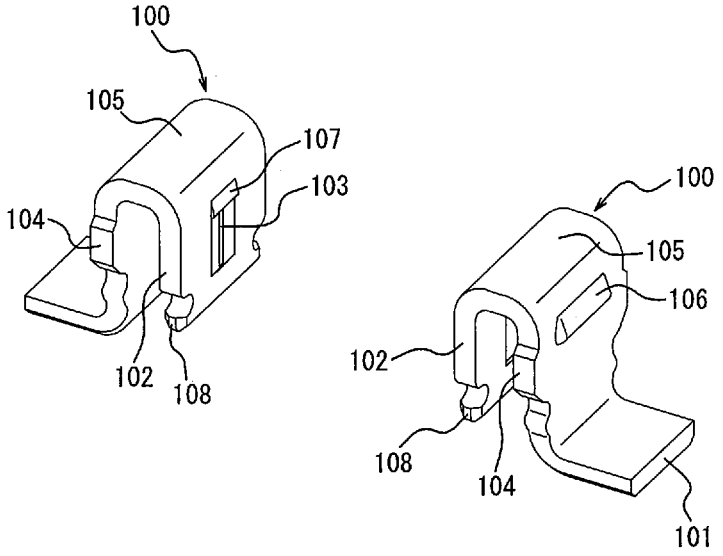
FIG. 19 is a top perspective view of a plug power-source contact.
Figure 20:
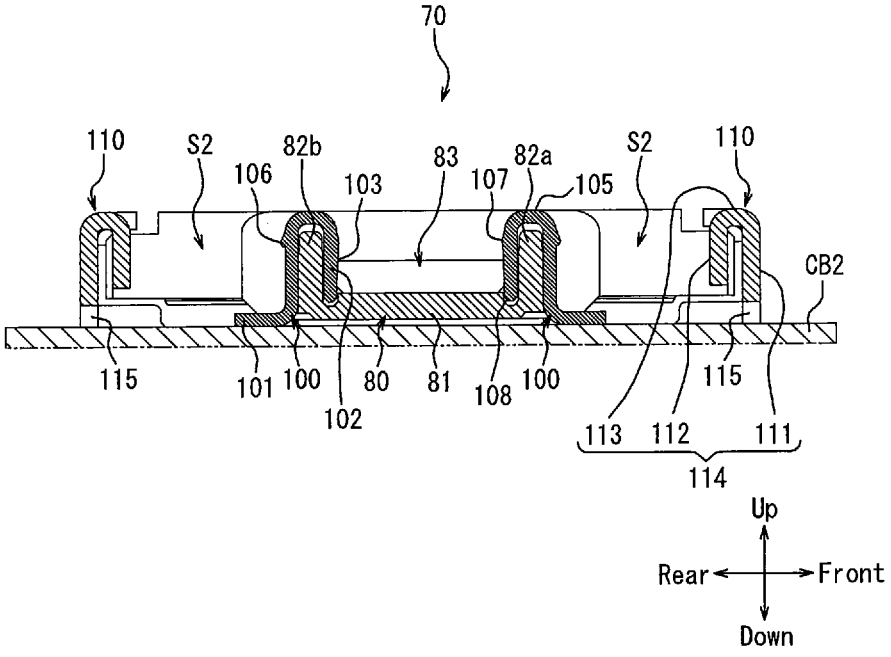
FIG. 20 is a cross-sectional view taken from arrow XX-XX of FIG. 15.
Figure 21:
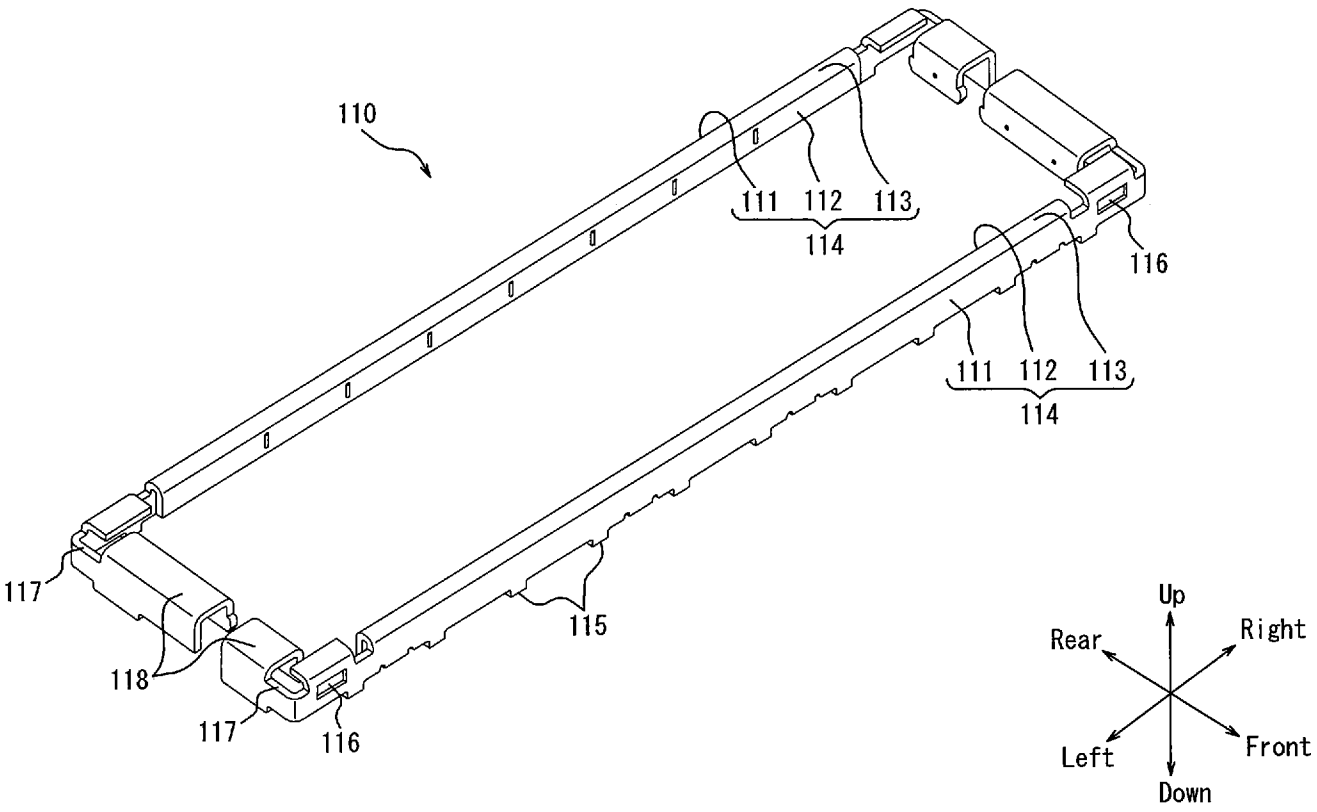
FIG. 21 is a top perspective view of a pair of plug shielding members.

FIG. 14 is a top perspective view of the plug connector 70. FIG. 15 is a top view of the plug connector 70. FIG. 16 is a top perspective view of a plug insulator 80 of a molded plug 75. FIG. 17 is a top perspective view of plug contacts 90. FIG. 18 is a cross-sectional view taken from arrow XVIII-XVIII of FIG. 15. FIG. 19 is a top perspective view of plug power-source contacts 100. FIG. 20 is a cross-sectional view taken from arrow XX-XX of FIG. 15. FIG. 21 is a top perspective view of a pair of plug shielding members 110.

The plug connector 70 primarily includes the molded plug 75, four plug power-source contacts 100, and a pair of plug shielding members 110 (second shielding members). The molded plug 75 is constituted by the plug insulator 80 (a second insulator) and a plurality of plug contacts 90 (contacts).

The molded plug 75 is a plate-like member extending in the left-right direction formed by insert-molding of a synthetic resin material having insulating and heat-resistant properties, together with a plurality of the plug contacts 90. The plug insulator 80 constituting the molded plug 75 includes a bottom plate 81 constituting the bottom, and an annular wall 82 protruding upward from the entire periphery of the top surface of the bottom plate 81 (see FIG. 16). A space formed by the bottom plate 81 and the annular wall 82 constitutes a fitting recess 83.

On the front wall 82*a* and the rear wall 82*b* of the annular wall 82, a plurality of contact supporting grooves 84 formed in an approximate U-shape across the front, rear, and top surfaces are arranged in a line in the left-right direction. The plurality of contact supporting grooves 84 retain corresponding plug contacts 90. The number of the plurality of contact supporting grooves 84 is equal to the number of the plug contacts 90.

In the left and right end portions of the front wall 82*a*, a power-source contact fitting groove 85 which is an approximate U-shape in cross-section is formed in a recessed manner across the front, rear, and top surfaces. Similarly, in the left and right end portions of the rear wall 82*b*, a power-source contact fitting groove 85 which is an approximate U-shape in cross-section is formed in a recessed manner across the front, rear, and top surfaces. The plug power-source contact 100 is fitted to the power-source contact fitting grooves 85. The number of the power-source contact fitting grooves 85 is equal to the number of the plug power-source contacts 100.

In the left and right end portions of the plug insulator 80, a pair of supports 86 that support two plug shielding members 110 are formed. The pair of supports 86 are in a point-symmetrical arrangement with respect to the left and right end portions of the plug insulator 80. In each of the right and left end portions, the pair of supports 86 are formed such that one of front-rear direction lengths is shorter than the other. A front-rear width of the pair of supports 86 in its entirety, in each of the right and left end portions, is wider than the front-rear width of the annular wall 82.

Each of the plug contacts 90 is formed by processing a thin plate made of a copper alloy (e.g., phosphor bronze, beryllium copper, or titanium copper) or Corson copper alloy into a shape as illustrated in the figure (see FIG. 17) by using the progressive die (stamping). Each of the plug contacts 90 is plated with gold or tin after nickel plate undercoating.

The plug contact 90 includes a mounting portion 91 that extends outward in an approximate L shape. The plug contact 90 includes a contact portion 92 (a second contact portion) that faces inward and is continuous with the top end portion of the mounting portion 91 and an extending portion 93 that extends outward in an approximate U-shape from the contact portion 92. The plug contact 90 further includes a plug projection 94 formed on top of the contact portion 92 and a guide 95 formed on top of the extending portion 93.

A distal end of the approximate U-shape of the extending portion 93 is positioned at substantially the same height as the contact portion 92.

Each of the plug contacts 90 is fitted to the corresponding contact supporting groove 84 by contacting the entire inner surface of the mounting portion 91 excluding the distal end thereof and the contact supporting groove 84 (see FIG. 18). When the plug contact 90 is fitted to the plug insulator 80 (the contact supporting groove 84), the mounting portion 91 of each of the plug contacts 90 is positioned on the outer peripheral side of the annular wall 82. That is, the distal end portion of the mounting portion 91 of each of the plug contacts 90 is positioned outside the annular wall 82.

The plug power-source contact 100 includes a mounting portion 101 that extends outward in an approximate L-shape (see FIG. 19). The plug power-source contact 100 includes an extending portion 102 that is continuous from to the top internal end of the mounting portion 101 and internally extends in an approximate U-shape, and a contact portion 103 that faces inward on the outer surface of the extending portion 102. The plug power-source contact 100 includes a latch 104 protruding from each of the left and right side surfaces of the outer portion of the extending portion 102, and a guide 105 formed on top of the extending portion 102. The plug power-source contact 100 also includes a first projection 106 which protrudes outward on the outer surface of the extending portion 102, and a second projection 107 formed on a top portion of the contact portion 103. The plug power-source contact 100 further includes a stabilizer 108 formed in the distal end portion of the approximate U-shape of the extending portion 102.

Each of the plug power-source contacts 100 is press-fit to the molded plug 75 from thereabove and, when the outer groove of the power-source contact fitting groove 85 and the latch 104 are engaged together, is fitted to each of the power-source contact fitting grooves 85 (see FIG. 14, FIG. 16, and FIG. 20). When the plug power-source contact 100 is fitted to the molded plug 75 (the power-source contact fitting groove 85), the mounting portion 101 of each of the plug power-source contacts 100 is positioned on the outer peripheral side of the annular wall 82. That is, the top distal end of the mounting portion 101 of each of the plug power-source contacts 100 is positioned outside the annular wall 82. The stabilizer 108 of each of the plug power-source contacts 100 is engaged with the deepest portion inside the power-source contact fitting groove 85 (see FIG. 20).

Each of the pair of plug shielding members 110 are the same component having the same shape (see FIG. 21). Each of the plug shielding members 110 is formed by press forming a metal plate (a conductive material). Each of the plug shielding members 110 includes an outer peripheral side shielding portion 11 (a second outer peripheral side shielding portion) having a flat-plate shape that constitutes an outer surface thereof and extends in the left-right direction. Inside the outer peripheral shielding portion 111, an inner peripheral shielding portion 112 made up of a flat plate parallel to the outer peripheral shielding portion 111 is located. The left-right direction width of the inner peripheral shielding portion 112 is shorter than the outer peripheral shielding portion 111. A bottom edge of the inner peripheral shielding portion 112 is located above the bottom edge of the outer peripheral shielding portion 111 (see FIG. 18, FIG. 20, and FIG. 21). The plug shielding member 110 includes a bend connecting portion 113 that couples the top edge portion of the inner peripheral shielding portion 11 and the top edge portion of the outer peripheral shielding portion 111 together. The bend connecting portion 113 is curved upward in cross-section. The outer peripheral shielding portion 111, the inner peripheral shielding portion 112, and the bend connecting portion 113 together form a bend 114 that is bent in an approximate U-shape. The bend 114 is formed toward the molded plug 75.

The plug shielding member 110 includes a plurality of mounting portions 115 (second mounting portions) that are formed on the bottom of the outer peripheral shielding portion 111 in a manner spaced apart from each other. The mounting portions 115 linearly extend in the up-down direction (in the fitting direction of the first connector and the second connector) from the bottom of the outer peripheral shielding portion 111.

The plug shielding member 110 includes latches 116 (second engaging portions) formed in a recessed manner in the left and right end portions on the outer side (see FIG. 21). The positions of the latches 116 correspond to the positions of the latches 66 of the receptacle shielding member 60. A pair of latches 116 are formed in a recessed manner in the left and right end portions on the outside of the outer peripheral shielding portion 111. The plug shielding member 110 includes a pair of transverse portions 117 that extends toward the plug insulator 80 from the left and right ends of the outer peripheral shielding portion 111. The transverse portions 117 opposite to each other have asymmetric lengths in the front-rear direction. In particular, of the opposing transverse portions 117, one of the transverse portion 117 has a front-rear direction length shorter than that of the other transverse portion 117. The one of the transverse portions 117 having the longer front-rear direction length has a front-rear width greater than half the front-rear width of the plug connector 70 in its entirety. The pair of transverse portions 117 include respective fitting portions 118. The fitting portion 118 has an approximate U-shape in cross-section. That is, the fitting portion 118 is constituted by three surfaces: the left surface, the right surface, and the top surface. One of the fitting portions 118 has the front-rear direction length shorter than that of the other fitting portion 118. The top of the fitting portion 118 has an R-shape.

Each of the plug shielding members 110 is fitted to the molded plug 75 by the engagement between the pair of fitting portions 118 and the supports 86 from thereabove (see FIG. 14, FIG. 18, and FIG. 20). When the plug shielding member 110 is fitted to the molded plug 75, the plug shielding member 110 is partially spaced apart from the plug insulator 80. In particular, the annular wall 82 and the inner peripheral shielding portion 112 are spaced apart from each other in the front-rear direction. That is, a space S2 extending across the left-right direction is formed between the annular wall 82 and the inner circumferential shielding portion 112. At this point, the distal end of the mounting portion 91 of the plug contact 90 and the distal end of the mounting portion 101 of the plug power-source contact 100 are visible from the up-down direction (the fitting direction of the first connector and the second connector) in the space S2 (FIG. 15).

The plug shielding member 110 has a double-shielding structure along the front-rear direction and the left-right direction. In particular, the shielding structure includes a double structure along the left-right direction with respect to the outer peripheral shielding portion 111 and the inner peripheral shielding portion 112 that have flat plate-like shapes. Similarly, the shielding structure also includes a double structure along the front-rear direction constituted by the left and right side surfaces of the fitting portion 118.

The plug connector 70 having the structure described above is mounted on a mounting surface formed on one surface of the circuit board CB2 (a rigid substrate, a second circuit board, see FIG. 18 and FIG. 20), which is a plate parallel with the circuit board CB1. In particular, the mounting portion 91 of each of the plug contacts 90 is soldered to the circuit pattern formed on the mounting surface of the circuit board CB2. The mounting portion 101 of each of the plug power-source contacts 100 is soldered to a power-source pattern formed on the mounting surface. Each of the mounting portions 115 of the plug shielding member 110 is soldered to a ground pattern formed on the mounting surface. The mounting surface of the circuit board CB2 includes electronic components (e.g., a high-performance module, a semiconductor, a large capacity memory, etc.) mounted thereon other than the plug connector 70.

A process to couple the plug connector 70 to the receptacle connector 20 will be described.

Figure 22:
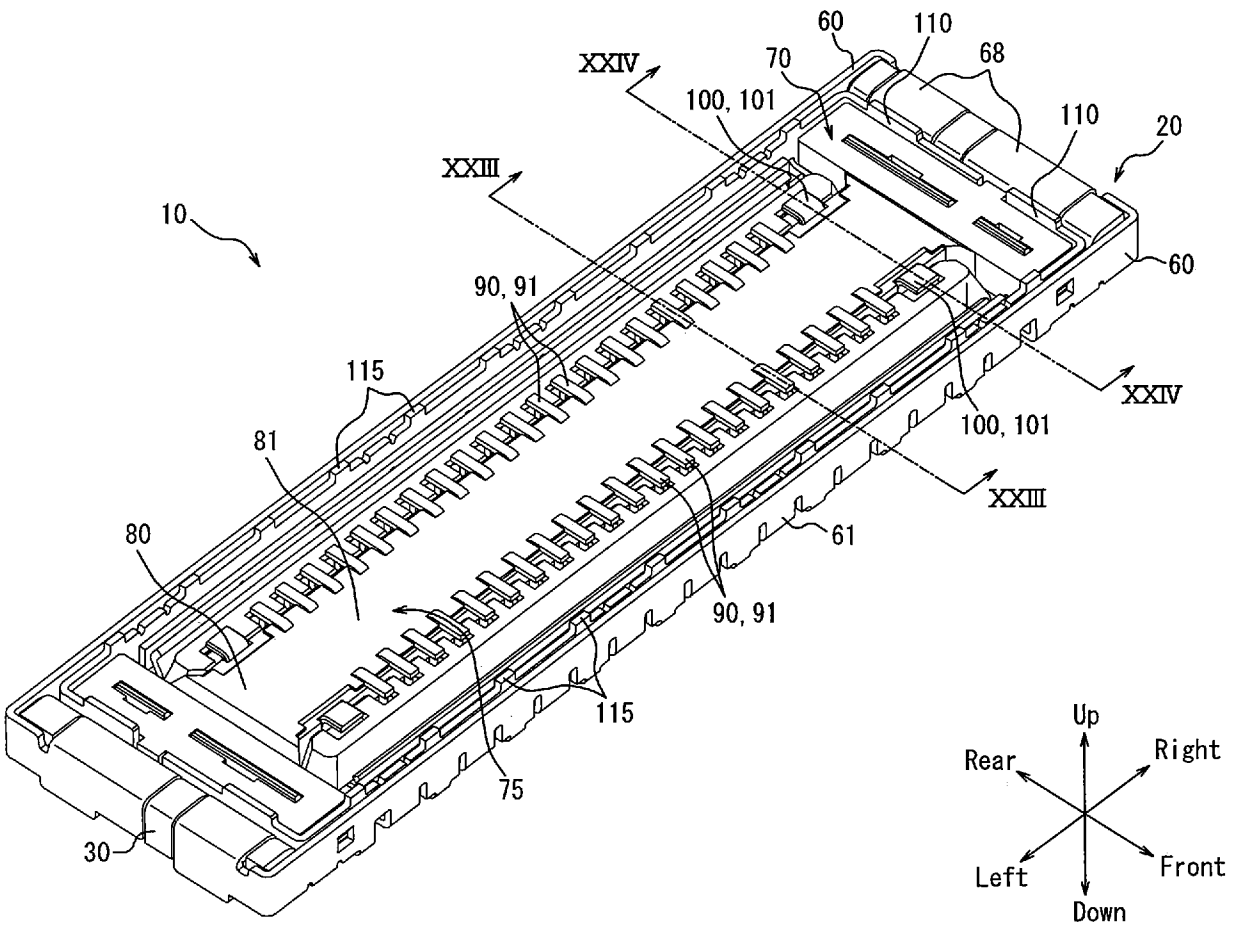
FIG. 22 is a top perspective view of a state of the connector of FIG. 1 in which the receptacle connector and the plug connector are fit together.
Figure 23A:
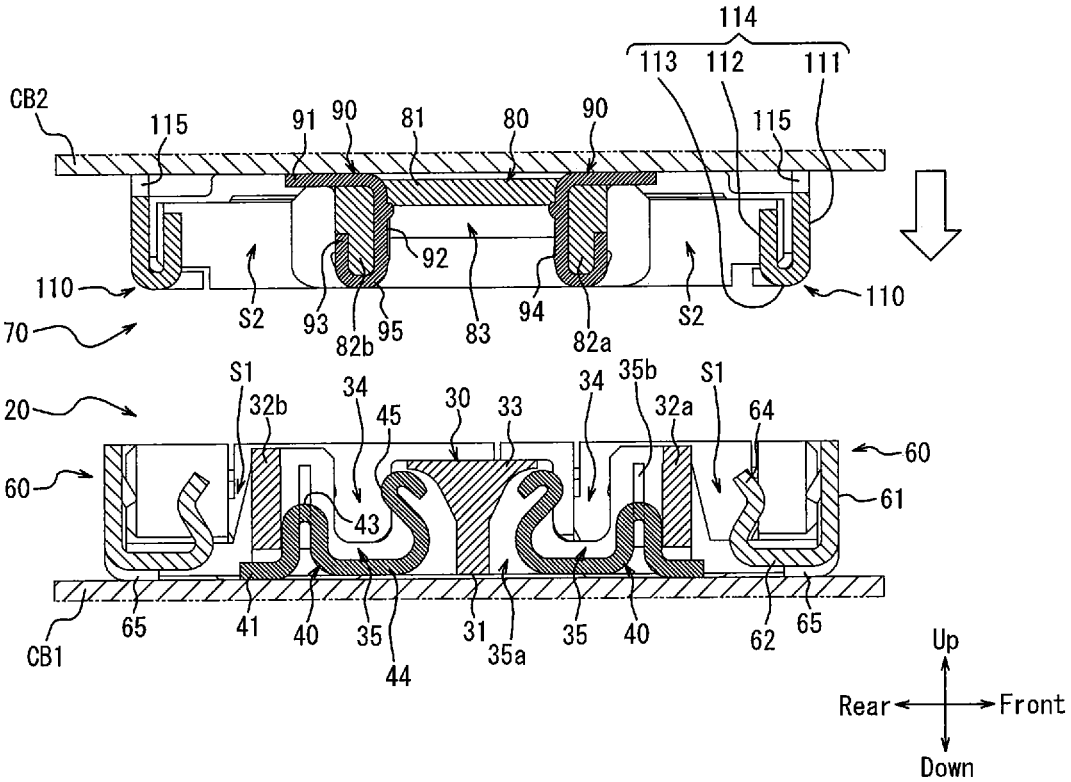
FIG. 23A is a cross-sectional view taken from arrow XXIII-XXIII of FIG. 22 illustrating a state before the receptacle connector and the plug connector are fit together.
Figure 23B:
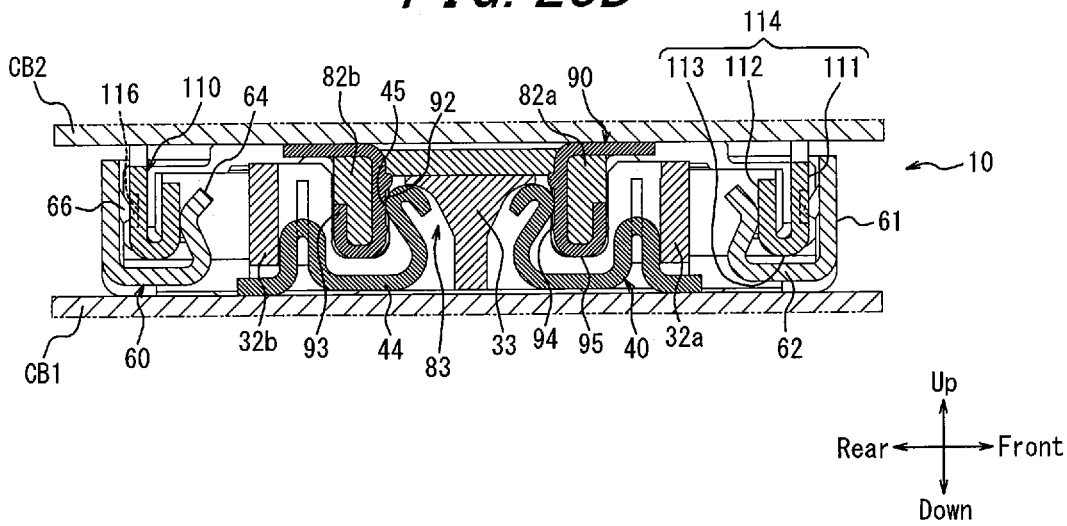
FIG. 23B is a cross-sectional view taken from arrow XXIII-XXIII of FIG. 22 illustrating a state after the receptacle connector and the plug connector are fit together.
Figure 24A:
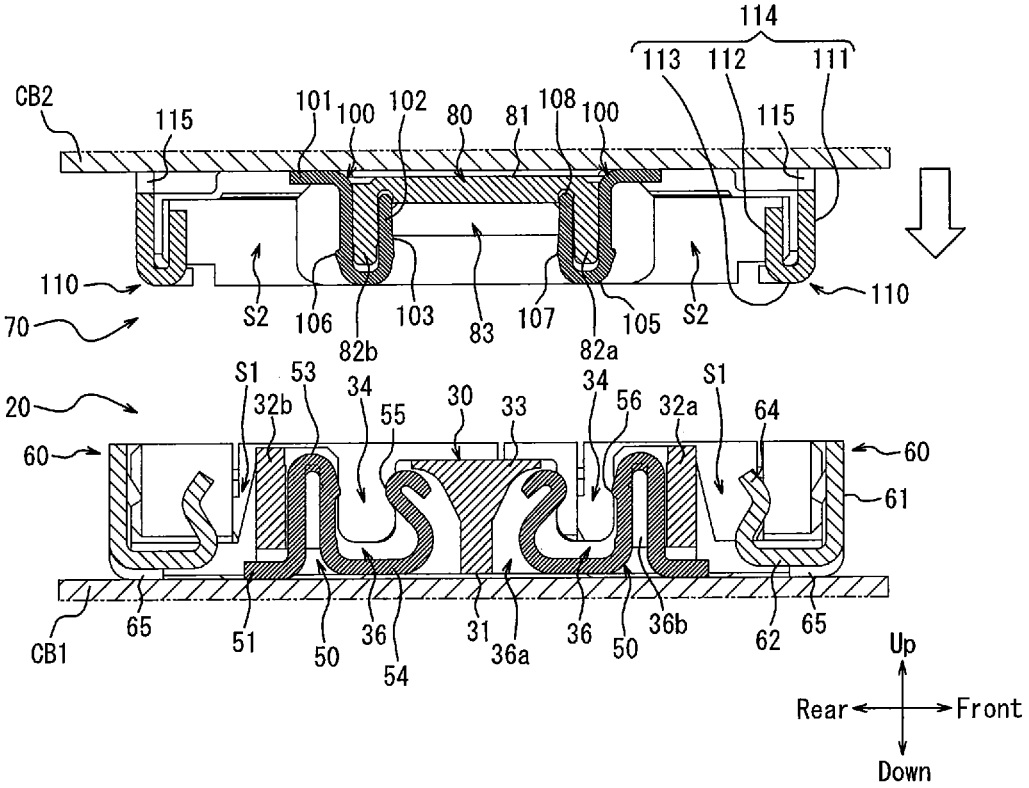
FIG. 24A is a cross-sectional view taken from arrow XXIV-XXIV of FIG. 22 illustrating a state before the receptacle connector and the plug connector are fit together.
Figure 24B:
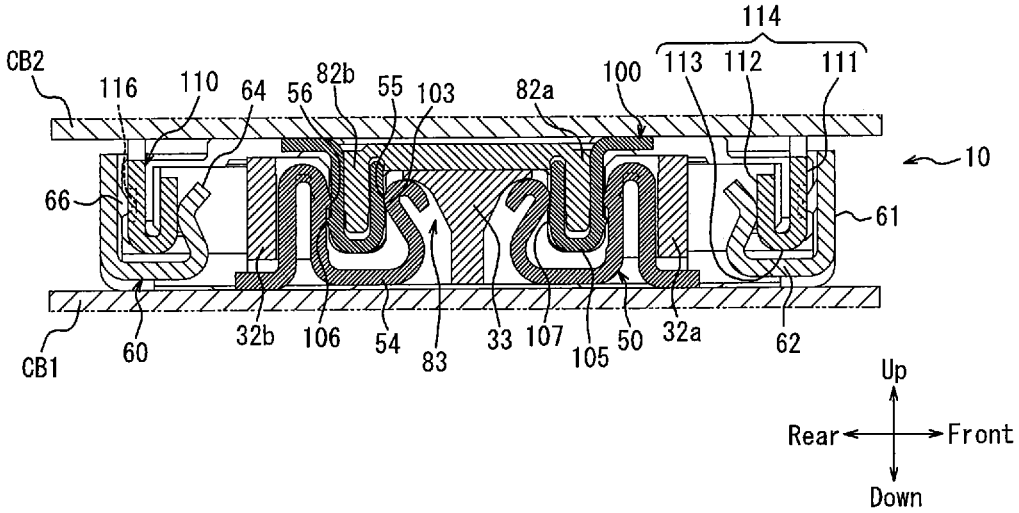
FIG. 24B is a cross-sectional view taken from arrow XXIV-XXIV of FIG. 22 illustrating a state after the receptacle connector and the plug connector are fit together.

FIG. 22 is a top perspective view of a state of the connector 10 of FIG. 1 in which the receptacle connector 20 and the plug connector 70 are fitted together. FIG. 23A and FIG. 23B are cross-sectional views taken from arrow XXIII-XXIII of FIG. 22 illustrating a state in which the receptacle connector 20 and the plug connector 70 are being fitted together. FIG. 23A illustrates a state before the fitting, and FIG. 23B illustrates a state after the fitting. FIG. 24A and FIG. 24B are cross-sectional views taken from arrow XXIV-XXIV of FIG. 22 illustrating a state in which the receptacle connector 20 and the plug connector 70 are being fitted together. FIG. 24A illustrates a state before the fitting, and FIG. 24B illustrates a state after the fitting.

As illustrated in FIG. 1, FIG. 23A, and FIG. 24A, in a state in which the plug connector 70 is arranged upside down, the receptacle connector 20 and the plug connector 70 are brought to oppose each other in the up-down direction while their positions with respect to the front-rear and left-right directions substantially matching one another. Then, the plug connector 70 is moved downward. In a case where the positions of the receptacle connector 20 and the plug connector 70 are slightly deviated from each other in the front-rear direction, the top edge portion of the outer peripheral shielding portion 61 is positioned slightly above the top surfaces of the outer peripheral wall 32 and the fitting projection 33 of the receptacle insulator 30, as described above, and first abuts the curved connecting portion 113 of the plug shielding member 110. Thus, the plug connector 70 is guided into the receptacle connector 20. Similarly, even when the positions of the receptacle connector 20 and the plug connector 70 are slightly deviated from each other in the left-right direction, the bottom edge of the fitting portion 118 of the plug shielding member 110 and the top end portion of the fitting portion 68 of the receptacle shielding member 60, which also has an R-shape, come into contact with each other. Thus, the bottom edge of the fitting portion 118 is guided by the top end portion of the fitting portion 68.

On the other hand, when, for example, the receptacle connector 20 and plug connector 70 are deviated from each other in the left-right direction, the fitting portion 68 of the receptacle connector 20 abuts the fitting portion 118 of the plug connector 70, as described above. Thus, the receptacle connector 20 and plug connector 70 do not fit together. In this case, even if an attempt is made to forcibly fit these connectors, the metal planes of the fitting portion 68 and the fitting portion 118 abut each other. Accordingly, the connector 10 can prevent damage to the receptacle connector 20 and plug connector 70.

When the plug connector 70 is further moved downward, even if, for example, the receptacle connector 20 and the plug connector 70 are slightly deviated from each other in the front-rear direction, the bottom end surfaces of the front wall 82*a* and the rear wall 82*b* including the guide 95 of the plug contact 90 and the guide 105 of the plug power-source contact 100 come into contact with the internal end portion of the outer peripheral wall 32. Thus, the front wall 82*a* and the rear wall 82*b* enter the fitting recess 34. That is, the guide 95 of the plug contact 90 and the guide 105 of the plug power-source contact 100 enter the fitting recess 34 (see FIG. 23B and FIG. 24B). When the plug connector 70 is further moved downward, the guide 64 of the receptacle shielding member 60 guides the bend 114 of the plug shielding member 110 downward.

At this point, the plug projection 94 of the plug contact 90 and the contact portion 45 of the receptacle contact 40 come into contact with each other, and the plug projection 94 causes elastic deformation of the elastic contact piece 44 in an inward direction within the deformation allowing groove 35*a*. Then, the plug projection 94 moves downward and rides over the contact portion 45, causing the contact portion 92 and the contact portion 45 to come into contact with each other. The plug contact 90 and the receptacle contact 40 contact each other at one point where the contact portion 92 and the contact portion 45 contact each other. In particular, a portion of the contact portion 45 most protruding toward the bend 43 and a corresponding part of the contact portion 92 together form such a contact point. In this way, the circuit board CB2 and the circuit board CB1 may be electrically conducted via the plug contact 90 and the receptacle contact 40.

Similarly, the first projection 106 and second projection 107 of the plug power-source contact 100 cause elastic deformation of the elastic contact piece 54 in such a manner as to widen the space between the projection 56 and the contact portion 55. Then, the first projection 106 and the second projection 107 move downward and ride over the projection 56 and the contact portion 55, respectively. Subsequently, the first projection 106 and the projection 56 are engaged together, and the contact portion 103 and the contact portion 55 come into contact with each other. The plug power-source contact 100 and the receptacle power-source contact 50 contact each other at two points where the first projection 106 and the projection 56 are engaged together and where the contact portion 103 and the contact portion 55 contact each other. In this way, both the circuit board CB2 and the circuit board CB1 may receive power supply via the plug power-source contact 100 and the receptacle power-source contact 50.

At this point, the fitting recess 83 is fitted to the fitting projection 33, and the front wall 82*a* and the rear wall 82*b* of the annular wall 82 are fit to the fitting recess 34 (FIG. 22, FIG. 23B, and FIG. 24B). The plug shielding member 110 is fit to a corresponding receptacle shielding member 60. In particular, when the plug shielding member 110 and the receptacle shielding member 60 are fit together, the bend 114 is received by the elastic deformation portion 62. At this point, a space is formed between the outer peripheral shielding portion 111 of the plug shielding member 110 and the outer peripheral shielding portion 61 of the receptacle shielding member 60. The bend 114 and the elastic deformation portion 62 come into contact with each other at one point on the inner side in a cross-sectional view. In particular, the inner peripheral shielding portion 112 and the top end portion of the elastic deformation portion 62 come into contact with each other at one internal point in the cross-sectional view.

The latch 116 of the plug shielding member 110 and the latch 66 of the receptacle shielding member 60 are engaged together.

Thus, the receptacle connector 20 and the plug connector 70 are fully coupled to each other.

At this point, in the state in which the receptacle shielding member 60 and the plug shielding member 110 are fitted together, they are partially spaced apart from the receptacle insulator 30 and the plug insulator 80, respectively. In particular, the elastic deformation portion 62 and the guide 64 are spaced apart from the outer peripheral wall 32 and the annular wall 82 in the front-rear direction. The inner peripheral shielding portion 112 is spaced apart from the outer peripheral wall 32 and the annular wall 82 in the front-rear direction.

The position of the space between the pair of receptacle shielding members 60 and the position of the space between the pair of plug shielding members 110 are deviated from each other in the transverse direction (see FIG. 22). In particular, the spaces formed in the front-rear direction at the left and right end portions by the pair of receptacle shielding members 60 do not overlap with the spaces formed in the front-rear direction at the left-right end portions by the pair of plug shielding members 110. That is, the inner side of the receptacle connector 20 and the plug connector 70 coupled to each other is fully enclosed by the pair of receptacle shielding members 60 and the pair of plug shielding members 110.

The connector 10 described above having a reduced profile is capable of reliably bringing the receptacle shielding member 60 and the plug shielding member 110 into contact with each other. Thus, the connector 10 may improve the rigidity of the shielding structure configured by the receptacle shielding member 60 and the plug shielding member 110. The connector 10 can improve the rigidity of the plug shielding member 110 because the plug shielding member 110 includes the bend 114. Thus, the connector 10 may prevent curvature, bending, and damage during fitting or mounting. Because the receptacle shielding member 60 includes the elastic deformation portion 62 and the guide 64, the fit between the plug shielding member 110 and the receptacle shielding member 60 may be further improved.

Because the space is formed between the outer peripheral shielding portion 61 and the outer peripheral shielding portion 111 during fitting, the connector 10 may have tolerance for minor positional deviation and bending of the receptacle shielding member 60 or the plug shielding member 110. That is, the connector 10 may suppress the impact on the fit between the receptacle contact 40 and the plug contact 90 caused by the positional deviation and bending described above during fitting of the receptacle shielding member 60 and the plug shielding member 110.

Because the latch 66 and the latch 116 are engaged together, the connector 10 may firmly couple the receptacle connector 20 and the plug connector 70 together.

The receptacle shielding member 60 includes a plurality of through holes 63. Thus, the connector 10 having a reduced profile may allow the elastic deformation portion 62 to have a sufficient spring length. That is, the elastic deformation portion 62 may have excellent compliance and resistance to plastic deformation. In this way, the connector 10 facilitates the elastic deformation of the elastic deformation portion 62 and improves the fi between the receptacle shielding member 60 and the plug shielding member 110, as well as preventing damage. The connector 10 includes a plurality of through holes 63 and thus may secure spaces to dispose the mounting portions 65.

The receptacle shielding member 60 includes the mounting portion 65. Thus, the connector 10 may allow electrical conduction between the receptacle shielding member 60 and the ground pattern of the circuit board CB1 by soldering. Similarly, the plug shielding member 110 includes the mounting portion 115. Thus, the connector 10 may allow electrical conduction between the plug shielding member 110 and the ground pattern of the circuit board CB2 by soldering. Thus, the connector 10 may efficiently prevent external noise from entering the receptacle contact 40 or the plug contact 90 and prevent noise from the receptacle contact 40 and the plug contact 90 from leaking to the outside.

In the connector 10, the mounting portions 65 of the receptacle shielding members 60 extend inward. Thus, the mounting portions 65 may be disposed within the receptacle shielding member 60. Thus, the connector 10 may efficiently shield the noise.

In the connector 10, the mounting portions 115 of the plug shielding member 110 extend linearly. Thus, during the fitting between the receptacle shielding member 60 and the plug shielding member 110, the top edge portion of the receptacle shielding member 60 may be positioned as close to the circuit board CB2 as possible. Accordingly, the connector 10 may enhance the noise-shielding effect.

In the connector 10, the receptacle shielding member 60 and the plug shielding member 110 are partially spaced apart from the receptacle insulator 30 and the plug insulator 80. Thus, the receptacle contacts 40 and the plug contacts 90 may be arranged within the receptacle shielding member 60 and the plug shielding member 110. Thus, the connector 10 may enhance the noise-shielding effect.

In the connector 10, the point contact between the elastic deformation portion 62 and the bend 114 enables guiding of the noise to the ground pattern without disturbing the flow of the noise. Thus, the connector 10 may enhance the noise-shielding effect. In the connector 10, as described above, the space is formed between the outer peripheral shielding portion 61 and the outer peripheral shielding portion 111 during fitting. Thus, the impact on the fitting between the receptacle contact 40 and the plug contact 90 caused by positional deviation and bending may be reduced.

In the connector 10, transverse lengths of the receptacle shielding members 60 and the plug shielding members 110 opposing each other are asymmetric, and the pair of receptacle shielding members 60 and the pair of plug shielding members 110 fully enclose the components therein without forming a space on the outer periphery thereof. Thus, the connector 10 may enhance the noise-shielding effect. In this way, the connector 10 may demonstrate a sufficient noise-shielding effect.

In the connector 10, the outer side of the receptacle shielding member 60 is constituted by the outer peripheral shielding portion 61 with the plate-like shape. Thus, external noise may be received in a plane. In the connector 10, similarly, the outer side of the plug shielding member 110 is constituted by the outer peripheral shielding portion 111 with the plate-like shape. Thus, external noise may be received in a plane. That is, the connector 10 may have a further stable noise-shielding effect as compared to connectors having an outer side with a complicated shape.

When the structures along the front-rear direction and the left-right direction of the receptacle shielding member 60 and the plug shielding member 110 are respective double structures, the noise-shielding effect of the connector 10 can be improved.

By virtue of the plug shielding member 110 first contacting the receptacle shielding member 60 upon fitting, the connector 10 may prevent damage to the plug contact 90 or the receptacle contact 40. Similarly, the connector 10 may also prevent damage to the plug insulator 80 and the receptacle insulator 30.

The top end portion of the fitting portion 68 and the top end portion of the fitting portion 118 form R-shapes and realize a guiding function, by which the fitting property of the connector 10 can be improved.

In the connector 10, by virtue the fitting portion 68 and the fitting portion 118 having approximate U-shapes in cross-section, the portions of the receptacle insulator 30 and the plug insulator 80 corresponding to each other are protected in three directions, and damage to each insulator during fitting can be prevented.

The connector 10, even with reduced profile, facilitates confirmation of its mounting on the circuit boards CB1 and CB2. That is, a person is able to view the mounting portion 41 of the receptacle contact 40, the mounting portion 51 of the receptacle power-source contact 50, and the mounting portion 65 of the receptacle shielding member 60 in the up-down direction, and thus may readily confirm whether the soldering has been performed appropriately. Similarly, a person may view the mounting portion 91 of the plug contact 90 and the mounting portion 101 of the plug power-source contact 100 in the up-down direction, and thus may readily confirm whether the soldering has been performed appropriately.

The plug contact 90 and the plug power-source contact 100 include the guide 95 and the guide 105, respectively. Thus, the connector 10 may improve the fitting property. The connector 10 includes the stabilizer 108 and thus may prevent the plug power-source contact 100 from curling up from the molded plug 75 and regulate displacement when the plug power-source contacts 100 is supported by the molded plug 75.

In the connector 10, by virtue of the plug power-source contact 100 and the receptacle power-source contact 50 being in contact with each other at two points and clamped, the retention force of the receptacle connector 20 and plug connector 70 during fitting can be improved. In the connector 10, the plug projection 94, the first projection 106, and the second projection 107 may realize a displacement-prevention effect by serving as a wall over which the plug connector needs to ride in the removal direction of the plug connector 70. In other words, the connector 10 may improve the retention force at the time of fitting.

The connector 10 may provide a click sensation to a person during fitting by virtue of the plug projection 94, the first projection 106, and second projection 107. That is, the connector 10 contributes to an improvement in operability.

When the contact engagement projection 35*b* is positioned between the pair of latches 42 of the receptacle contact 40, the connector 10 may inhibit rotation of the receptacle contact 40 in the front-rear direction during assembly or during use. That is, the connector 10 may improve the accuracy of the retention position of the receptacle contact 40 with respect to the receptacle insulator 30.

Similarly, the power-source contact engaging projection 36*b* is positioned between the pair of latches 52 of the receptacle power-source contact 50. Thus, the connector 10 may inhibit rotation of the receptacle power-source contact 50 in the front-rear direction during assembly or during use. That is, the connector 10 may improve the accuracy of the retention position of the receptacle power-source contact 50 with respect to the receptacle insulator 30.

The receptacle contact 40 and the plug contact 90, even though the connector 10 has a reduced profile, are capable of obtaining excellent transmission characteristics for high frequency signals.

That is, in the receptacle contact 40, because the bend 43 is lower than the contact portion 45, a sufficient space may be provided between the bend 43 and the mounting portion 91 during fitting. Thus, the receptacle contact 40 may suppress crosstalk by inhibiting electrical coupling to the plug contact 90.

Because the elastic contact piece 44 is wider than the bend 43, the receptacle contact 40 may improve the transmission characteristics for high frequency signals. When the distal end of the elastic contact piece 44 is positioned at a height similar to the height of the contact portion 45, the receptacle contact 40 may improve the transmission characteristics of high-frequency signals in a similar manner.

In the plug contact 90, by virtue of the distal end position of the approximate U-shape of the extending portion 93 being positioned at a height similar to the top end position of the contact portion 92, the plug contact 90, stub components can be reduced and the transmission characteristics of high-frequency signals can be improved.

By virtue of the plug contact 90 and the receptacle contact 40 contacting each other at a single point at the time of fitting, disturbance of a current for a high frequency signal is suppressed, and the transmission characteristics can be improved.

In this way, high-speed communication with excellent transmission characteristics are enabled between an electronic device (e.g., a CPU, a controller, a memory, etc.) mounted on the circuit board CB1 and an electronic device (e.g., a high-performance module, a semiconductor, a large capacity memory, etc.) mounted on the circuit board CB2.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

For example, the configurations of the shielding members between the receptacle connector 20 and plug connector 70 may be interchanged.

The latch 66 may be formed as a recess, and the latch 116 may be formed as a claw shape.

In the connector 10, one of the outer peripheral shielding portion 111 and the inner shielding portion 112 may be omitted from the plug shielding member 110. In the connector 10, on the other hand, one or more shielding members other than the outer peripheral shielding portion 111 and the inner shielding portion 112 may be provided side by side in the front-rear direction with respect to the outer peripheral shielding portion 111 and the inner shielding portion 112. In the connector 10, similarly, one or more shielding members other than the outer peripheral shielding portion 61 may be provided side by side in the front-rear direction with respect to the outer peripheral shielding portion 61.

The bases of the receptacle shielding member 60 and the plug shielding member 110 may be made of resins, and the surfaces of the bases (the resins) may be plated or coated with an electrically conductive material.

REFERENCE SIGNS LIST

10 connector
20 receptacle connector (first connector)
30 receptacle insulator (first insulator)
31 bottom plate
32 outer peripheral wall
32*a* front wall
32*b* rear wall
33 fitting projection
34 fitting recess
35 contact fitting groove
35*a* deformation allowing groove
35*b* contact engaging projection
36 power-source contact fitting groove
36*a* deformation allowing groove
36*b* power-source contact engaging projection
37 support
40 receptacle contact (contact)
41 mounting portion
42 latch
43 bend
44 elastic contact piece
45 contact portion (first contact portion)
50 receptacle power-source contact
51 mounting portion
52 latch
53 bend
54 elastic contact piece
55 contact portion
56 projection
60 receptacle shielding member (first shielding member)
61 outer peripheral shielding portion (first outer peripheral shielding portion)
62 elastic deformation portion
63 through hole
64 guide
65 mounting portion (first mounting portion)
66 latch (first engaging portion)
67 transverse portion
68 fitting portion
70 plug connector (second connector)
75 molded plug
80 plug insulator (second insulator)
81 bottom plate
82 annular wall
82*a* front wall
82*b* rear wall
83 fitting recess
84 contact supporting groove
85 power-source contact fitting groove
86 supporting portion
90 plug contact (contact)
91 mounting portion
92 contact portion (second contact portion)
93 extending portion
94 plug projection
95 guide
100 plug power-source contact
101 mounting portion
102 extending portion
103 contact portion
104 locking portion
105 guide
106 first projection
107 second projection
108 stabilizer
110 plug shielding member (second shielding member)
111 outer peripheral shielding portion (second outer peripheral shielding portion)
112 inner peripheral side shielding portion
113 curved connecting portion
114 bend
115 mounting portion (second mounting portion)

116 latch (second engaging portion)
117 transverse portion
118 mounting portion
CB1 circuit board (first circuit board)
CB2 circuit board (second circuit board)
S1 space
S2 space

The invention claimed is:

1. A connector comprising:

a first connector equipped with a first insulator that includes a pair of outer peripheral walls opposing each other, and a fitting projection formed between said pair of outer peripheral walls, and a first shielding member supported by said first insulator; and a second connector equipped with a second insulator having a fitting recess fit to said fitting projection, and a second shielding member supported by said second insulator, wherein, when said first connector and said second connector are fitted to each other, a part of one of said first shielding member and said second shielding member is located inside a double structure provided along a side of the other.

2. The connector according to claim 1, wherein said second shielding member includes a bend curved in an U-shape, and said first shielding member includes an elastic deformation portion that accommodates said bend when said first shielding member is fitted to said second shielding member.

3. The connector according to claim 2, said first shielding member includes a first outer peripheral shielding portion constituted by an outer surface, said second shielding member includes a second outer peripheral shielding portion constituted by an outer surface, and when said first connector and said second connector are fitted to each other, a space is formed between said first outer peripheral shielding portion and said second outer peripheral shielding portion.

4. The connector according to claim 2, wherein said first shielding member includes a first latch at an internal end portion, said second shielding member includes a second latch at a position corresponding to said internal end portion, and said first latch and said second latch engage each other when said first connector and said second connector are fitted to each other.

5. The connector according to claim 2, wherein said first shielding member includes a guiding portion that protrudes from a top end of said elastic deformation portion in an inclined manner toward the inside of said first insulator.

6. The connector according to claim 2, wherein said first shielding member includes a plurality of through holes that are formed throughout said elastic deformation portion and spaced apart from one another at predetermined intervals.

7. The connector according to claim 3, wherein said first shielding member includes a plurality of first mounting portions formed at an end portion of said first outer peripheral shielding portion and spaced apart from one another at predetermined intervals.

8. The connector according to claim 7, wherein said first mounting portion extends inward in a L-shape from said end portion of said first outer peripheral shielding portion.

9. The connector according to claim 3, wherein said second shielding member includes a plurality of second mounting portions formed at an end portion of said second outer peripheral shielding portion and spaced apart from one another at predetermined intervals.

10. The connector according to claim 9, wherein said second mounting portion linearly extends in a fitting direction from said end portion of said second outer peripheral shielding portion.

* * * * *